US005552561A

United States Patent [19]

Nakada et al.

[11] Patent Number: 5,552,561

[45] Date of Patent: Sep. 3, 1996

[54] PLAYING-STYLE DETECTING APPARATUS AND ELECTRONIC MUSICAL INSTRUMENT UTILIZING THE SAME

[75] Inventors: Akira Nakada; Takeo Shibukawa; Yasuhiro Hinago; Junichi Mishima, all of Hamamatsu, Japan

[73] Assignee: Yamaha Corporation, Japan

[21] Appl. No.: 407,862

[22] Filed: Mar. 21, 1995

[30] Foreign Application Priority Data

Mar. 30, 1994 [JP] Japan ..... 6-084055

[51] Int. Cl.[6] ..... G10H 1/053; G10H 1/46

[52] U.S. Cl. ..... 84/658; 84/665; 84/DIG. 7

[58] Field of Search ..... 84/615–620, 626–633, 84/658, 687–690, DIG. 7, 665, 711

[56] References Cited

U.S. PATENT DOCUMENTS 5,144,876 9/1992 Hirano ..... 84/658

*Primary Examiner*—Stanley J. Witkowski

*Attorney, Agent, or Firm*—Graham & James LLP

[57] ABSTRACT

An electronic musical instrument can perform a musical-tone control according to a playing-style. In the instrument, a touch sensor is provided for each key on a keyboard, and pressure sensors are also provided under the keys. Each touch sensor detects a speed data corresponding to a depression speed of the key, and each pressure sensor detects a pressure data corresponding to an initial peak of a depression pressure after the start of the depression of the key. The instrument operates according to the speed data and the pressure data for discriminating between a standard playing-style which touches the key from an upside remote position and a push playing-style which starts depression of the key from a state where the key is touched. Values of the pressure data from the respective pressure sensors are different even if the speed data from the respective touch sensors are the same, so that the judgment is made as to which playing-style is performed on the corresponding key based on the speed data and the pressure data, thereby performing the musical-tone control according to the detected playing-style.

26 Claims, 16 Drawing Sheets

PLAYING-STYLE DETECTING APPARATUS AND ELECTRONIC MUSICAL INSTRUMENT UTILIZING THE SAME

BACKGROUND OF THE INVENTION

1. Field of the Invention

The present invention relates to a playing-style detecting apparatus and an electronic musical instrument utilizing the same. More particulary, it relates to a playing-style detecting apparatus which enables to control a musical tone by detecting a style of playing keys (hereinafter, referred to as "playing-style") based on an output from a touch sensor for sensing a depression speed of the key and another output from an aftersensor provided under the key for sensing a depression pressure of the key.

2. Related Background Art

Up to this time, an electronic keyboard instrument has been known, as shown in FIG. 21, which is provided with a touch sensor 2 for sensing a depression speed of a key 1 and a pressure sensor 3 for sensing a depression pressure of the key 1, so that a volume level at starting sound generation of a musical tone is controlled in accordance with the output from the touch sensor 2, and subsequently a volume level or an effect on tones after the start of the sound generation is controlled in accordance with the other output from the pressure sensor 3. Such an electronic keyboard instrument is disclosed, for example, in the U.S. Pat. No. 5,144,876. According to the above prior art, it is possible to impart various expressions on the musical tone according to the depression speed of the key or the depression pressure after touching the key, but it is not able to control the musical tone so as to impart a delicate expression according to the playing-style.

Generally, the playing-styles of the key include a standard playing-style in which a finger FN is bent down from an initial upward position at a distance d apart to strike a key K, as shown in FIG. 22A, and a push playing-style in which the depression of the key K is started from a state where the finger FN is placed on the key K, as shown in FIG. 22B. In the standard playing-style, the distance d is about 10 [cm] in case of producing a mezzo forte (mf tone) and it becomes about 20 [cm] or more in case of a fortissimo (ff tone) or a fortississimo (fff tone). In any case, an applied force is naturally released from the finger after touching the key. On the other hand, in the push playing-style, the key is further forced down under the finger pressure even after the key has reached the lower limit position.

An acoustic or natural keyboard instrument such as a piano can audibly create a delicate expression of the musical tone which is audibly different between the standard playing-style and the push playing-style. On the other hand, the above conventional electronic keyboard instrument may control musical tones after the sound generation according to the output from the pressure sensor 3 even if the musical tones have no difference in a key depression speed sensed by the touch sensor 2 of FIG. 21. However, the conventional electronic keyboard instrument cannot impart a different expression to the musical tone distinctive between the standard playing-style and the push playing-style, and this causes inconvenience that the expression of the key playing is rather poor.

SUMMARY OF THE INVENTION

It is a first object of the present invention to provide a playing-style detecting appratus for detecting a playing-style of a key. It is a second object of the present invention to provide a new electronic musical instrument which enables to perform a musical-tone control according to the playing-style. The above-mentioned objects can be attained, according to the present invention, by a playing-style detecting apparatus which comprises a key operable to undergo a depression, first detection means for detecting a first output data corresponding to a depression speed of the key, second detection means having an aftersensor provided under the key for detecting a second output data corresponding to an initial peak of a force applied to the key after a start of the depression of the key, and judgment means for determining a playing-style which is conducted in the depression of the key based on both of the first output data from the first detection means and the second output data from the second detection means and for outputting playing-style information that represents the determined playing-style. Such an apparatus can be applied to an electronic musical instrument. In this case, the electronic musical instrument is constracted such that the first output data (speed data) and the second output data (pressure data) are detected for each key of a keyboard, and a playing-style is determined based on these data so that musical-tone characteristics such as a timbre, a volume and an acoustic effect are controlled according to the result of the determination.

In the playing-style detecting apparatus of the present invention, when a key is depressed, the first detection means detects the speed data corresponding to a depression speed of the key, and the second detection means detects the pressure data corresponding to the initial peak after the start of the key depression. Then, the judgment means judges which playing-style is adopted for the depression play of the key based on the detected speed data and pressure data. According to the inventor's researches, it becomes clear that there is a difference in value of the pressure data, for example, between the standard playing-style and the push playing-style even if there is no difference in the speed data therebetween, or vice versa. Accordingly, the playing-style can be judged by obtaining the relationship between the speed data: and the pressure data in advance with respect to the standard playing-style and the push playing-style, and by utilizing the relationship for the recognition of the playing-style. The judgment means generates the playing-style information representing the playing-style as the result of the recognition. For each playing-style, musical-tone control information is determined according to the playing-style information, so that the characteristics of the musical-tone can be controlled in accordance with the playing-style information provided from the judgment means. Accordingly, it is possible to impart a delicate expression to the musical tone specific to the detected playing-style. Typically, a pressure sensor, for example, can be used for the aftersensor.

DETAILED DESCRIPTION OF THE PREFERRED EMBODIMENTS

Figure 1:
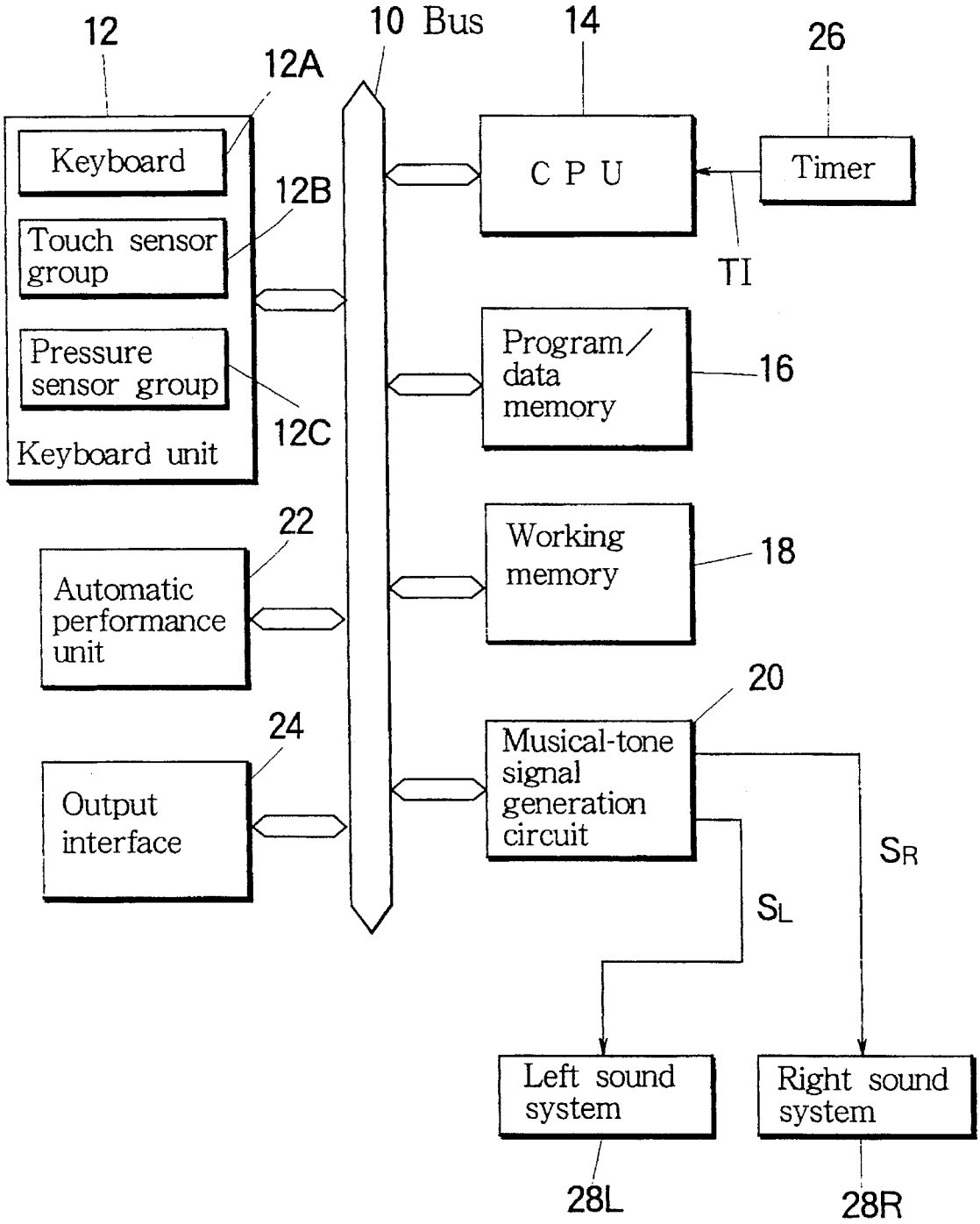
FIG. 1 is a block diagram showing a circuit structure of an electronic musical instrument according to an embodiment of the present invention.

FIG. 1 shows a circuit structure of an electronic musical instrument according to an embodiment of the present invention. In this electronic musical instrument, the musical-tone generation is controlled by a microcomputer. In FIG. 1, a bus 10 is connected to a keyboard unit 12, a central processing unit (CPU) 14, a memory 16 for storing program and data, a working memory 18, a musical-tone signal generation circuit 20, an automatic performance unit 22 and an output interface 24 etc.

The keyboard unit 12 is equipped with a keyboard 12A, e.g., having 88 keys in number, a touch sensor group 12B including touch sensors provided for each key on the keyboard 12A, and a pressure sensor group 12C including pressure sensors provided for each key on the keyboard 12A. Key operation information, such as a key event signal, a speed data and a pressure data, is detected in response to key operations of the keyboard 12A. A structural example of the keyboard unit 12 will be described later referring to FIG. 2.

The CPU 14 performs diverse processing for the musical-tone generation according to a program stored in the memory 16. These processings will be described later referring to flow charts of FIGS. 14 to 18 and 20. The CPU 14 is supplied with an interrupt signal TI from a timer 26. The interrupt signal TI is generated, for example, at a period of 1 [μsec], and an interrupt routine of FIG. 15 is called as this signal is generated.

The memory 16 memorizes various kinds of control data together with the control program. The control data concerned in realization of the present invention will be described later referring to FIGS. 10 and 11. The working memory 18 is composed of a random access memory (RAM) and it includes a memory area used for registers or flags in processing routines shown in FIGS. 14 to 18 and 20.

The musical-tone generation circuit 20 generates a right channel musical-tone signal $S_R$ and a left channel musical-tone signal $S_L$ based on the key operation information outputted from the keyboard unit 12. These musical-tone signals $S_R$ and $S_L$ are supplied respectively to a right sound system 28R and a left sound system 28L to be transformed into sounds.

The automatic performance unit 22 records the key operation information etc. outputted from the keyboard unit 12 and then carries out the performance reproduction (automatic performance) based on the recorded information. The automatic performance reproduction may be effected through the musical-tone generation circuit 20 and the sound systems 28R and 28L, or otherwise may be effected through a self musical-tone generation means included in the unit 22.

The output interface 24 is provided for outputting the key operation information etc. from the keyboard unit 12 to an external electronic musical instrument. By this, the external electronic musical instrument can be operated by the performance operation of the keyboard unit 12.

Figure 2:
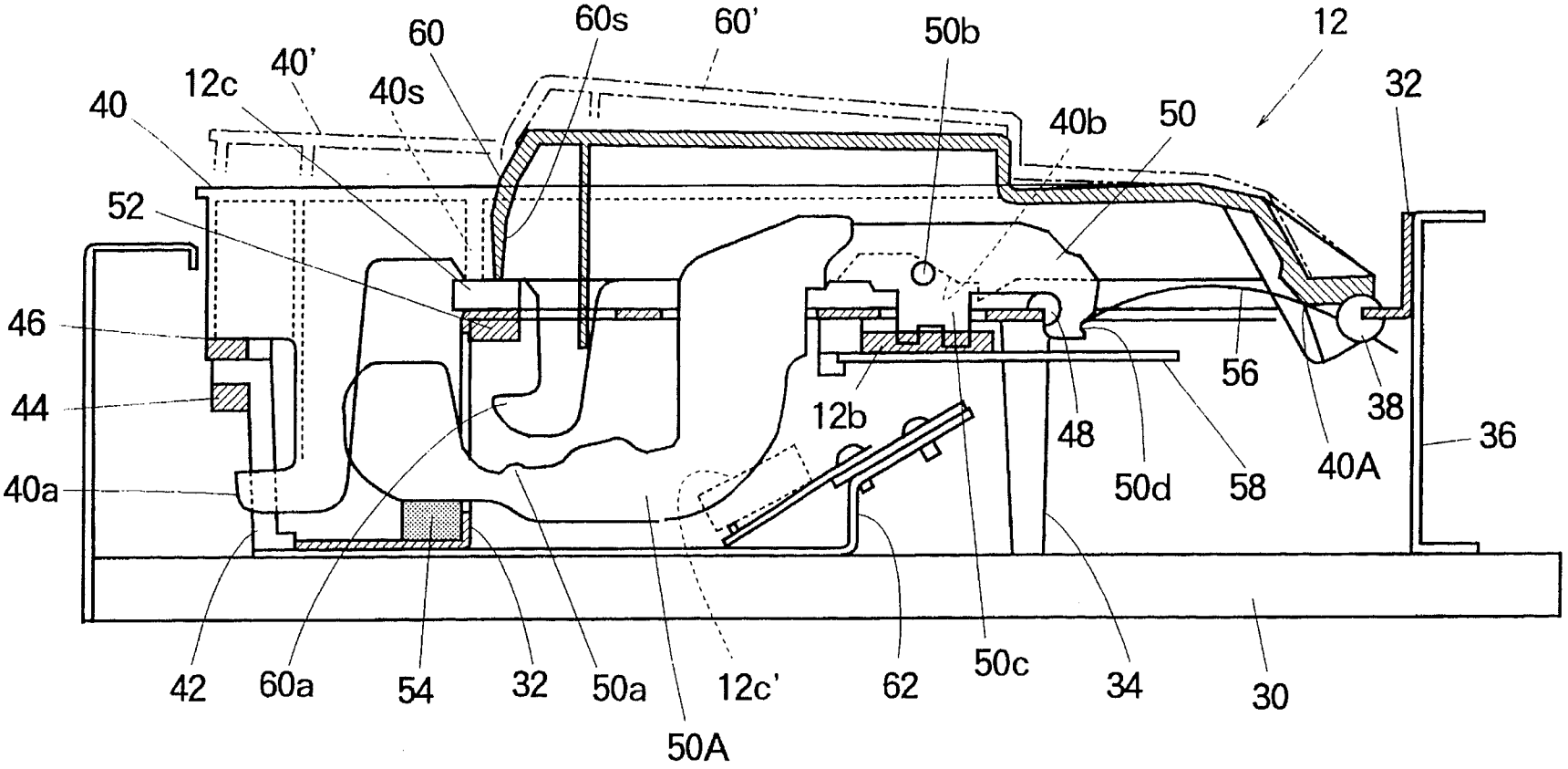
FIG. 2 is a sectional view showing a keyboard unit of the electronic musical instrument shown in FIG. 1.

FIG. 2 shows a structural example of the keyboard unit 12. A bottom plate 30 is provided as a musical instrument body. Supporting members 32 are installed thereon by a strut 34, supporting metal fittings 36 and the like. At one side of the supporting members 32, natural or white keys 40 are provided so as to move around a rotating shaft 38 as a supporting point. Then, a stopper holding member 42 is provided below a free end of each natural key 40 on the bottom plate 30. On the stopper holding member 42, an upper limit stopper 44 and a lower limit stopper 46 are installed for the natural keys. The natural key 40 is normally biased upward by a spring member 56, as shown by reference numeral 40'. In a released or free key state shown by 40', a lock portion 40*a* of the natural key 40 is locked by the stopper 44.

At the other side of the supporting members 32, a hammer 50 is provided below the natural key 40 such that the hammer 50 moves around a rotating shaft 48 as a supporting point. The hammer 50 has a hammer arm 50A formed of a metal such as iron or the like which serves as a mass, and a urethane cover outserted around the metal. The supporting member 32 is also provided with an upper limit stopper 52 for the hammer above the arm 50A and an lower limit stopper 54 for the hammer below the same arm 50A. The hammer 50 is normally biased upward by the spring member 56, one end of which is fixed to a holding portion 50*d*, and the other end of which is fixed to the supporting portion 40A of the natural key 40. In other words, the spring member 56 biases or urges both the natural key 40 and the hammer 50 in the upward direction. By this, in the released key state, a lock portion 50*a* of the hammer arm 50A is locked by the upper stopper 52.

At the widthwise side portions of each hammer 50, projections 50*b* are provided so as to engage with fit portions 40*b* of the key 40. In the lower portion of each hammer 50, an actuator 50*c* is also provided. A sensor holding plate 58 is installed under the supporting member 32 and below the actuator 50*c*. A touch sensor 12*b* is then provided on the sensor holding plate 58, and is actuated by the actuator 50*c* at the time of pushing the hammer 50 down. Each touch sensor 12*b* belongs to the touch sensor group 12B shown in FIG. 1.

Figure 3:
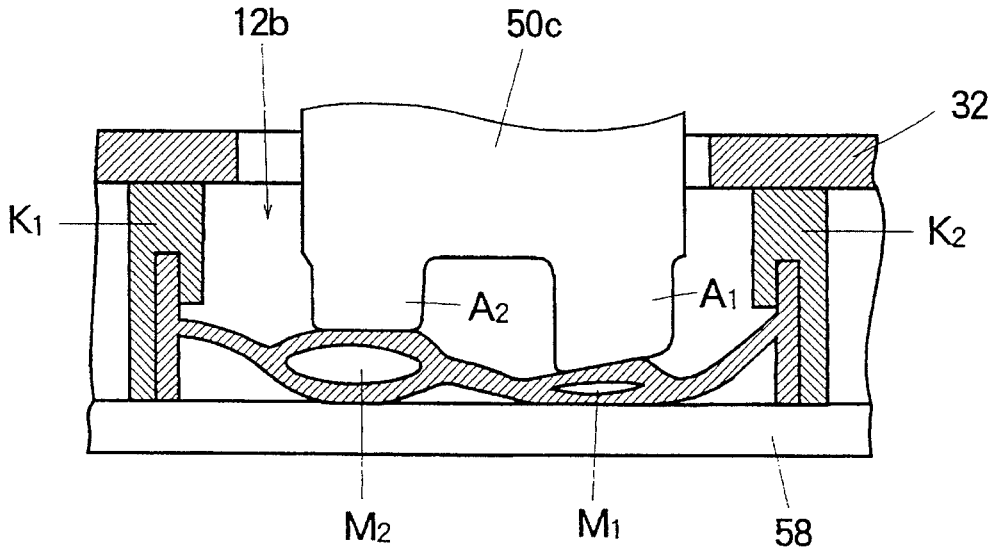
FIG. 3 is a sectional view showing an example of a touch sensor.

FIG. 3 shows a structural example of each touch sensor 12*b*. The touch sensor 12*b* includes two-make contacts M1 and M2 of spectacles shape, and is fixed on the sensor holding plate 58 by fixing members K1 and K2. The actuator 50*c* has a first lower projecting portion A1 which is relatively long and a second lower projecting portion A2 which is relatively short so that the projecting portion A1 turns on the make contact M1 and subsequently the projecting portion A2 turns on the other make contact M2 as the hammer 50 moves downward. On the contrary, the projecting portion A2 turns off the make contact M2 and subsequently the projecting portion A1 turns off the make contact M1 as the hammer 50 moves upward.

Returning to FIG. 2, a pressure sensor 12*c* is provided below the natural key 40 on the supporting member 32. Each pressure sensor 12*c* belongs to the pressure sensor group 12C of FIG. 1. The natural key 40 is provided with a pressing portion 40*s*. When one of the natural keys 40 is pushed down to strike the stopper 46, the lower end of the pressing portion 40*s* presses the pressure sensor 12*c*. In the embodiment of FIG. 2, the pressure sensor 12*c* is commonly used for natural and chromatic keys. To give an example of modification, a separate pressure sensor for the natural key 40 can be provided in the lower limit stopper 46 while the pressure sensor 12*c* is used for the black or chromatic key 60. In other words, the pressure sensors may be provided separately for the natural key 40 and the chromatic key 60. By applying the above arrangement, no error operation occures in case of a double touch even after aging, and this makes it possible to keep the accuracy permanently.

When one of the natural keys 40 is pushed down, the fit portion 40*b* abuts with the projection 50*b* to move the hammer 50 downward. At this moment, the contacts M1 and M2 of the touch sensor 12*b* are turned on in this order. An on-time interval between the contact M1 and the contact M2 becomes shorter as the depression speed is higher. As a result of measuring the time interval of the contacts M1 and M2 turned on in this order, a speed data corresponding to the depression speed of the key can be obtained.

The arm 50A of the hammer 50 strikes the stopper 54 and stops instantly. On the other hand, the natural key 40 presses the pressure sensor 12*c* with its pressing portion 40*s* substantially at the same time as it strikes the stopper 46. At this time, a pressure data corresponding to the depression pressure can be obtained from the pressure sensor 12*c*. Also after this, the pressure data from the pressure sensor 12*c* is outputted continuously as long as the natural key 40 is kept in the depressed state.

When the natural key 40 is released, the natural key 40 and the hammer 50 move upward. Then, the lock portion 40*a* is locked by the stopper 44, and the natural key 40 stops at the rest position. Similarly, the lock portion 50*a* is locked by the stopper 52, and the hammer 50 stops at the rest position.

Such an operation of the key mentioned above is similarly performed by the chromatic key 60. The chromatic key 60, however, differs from the natural key 40 in that the mass of a hammer corresponding to the chromatic key 60 is set smaller than the hammer corresponding to the natural key 40 at the top portion of the free end, that the pressure sensor 12*c* is used for the lower limit stopper of the chromatic key 60, and that the elastic strength of the spring member is set slightly smaller than that of the natural key 40. In the other points, the chromatic key 60 has the same structure as that of the natural key 40 so as to act similarly. As an aside, reference numeral 60' in FIG. 2 indicates a rest state where the chromatic key 60 is biased upward. Also, 60*a* indicates a lock portion of the chromatic key 60 locked by the upper limit stopper 52, and 60*s* indicates a pressing portion of the chromatic key 60 for pressing the pressure sensor 12*c*.

Figure 4:
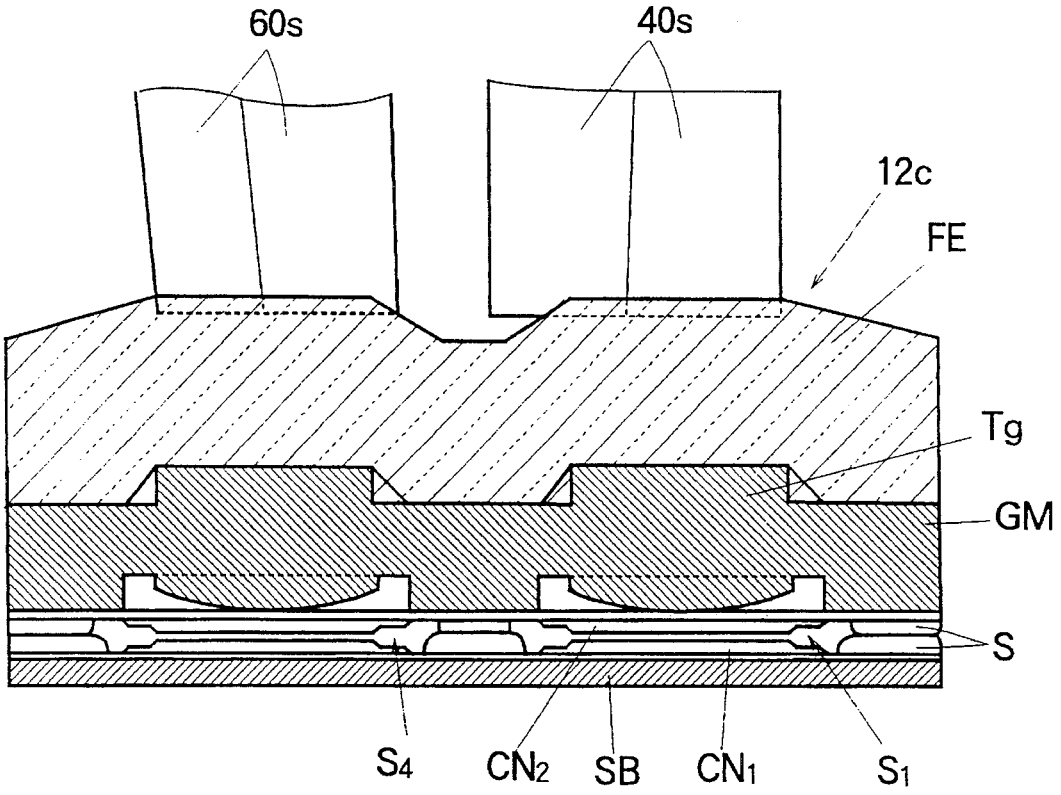
FIG. 4 is a sectional view showing an example of a pressure sensor.
Figure 5:
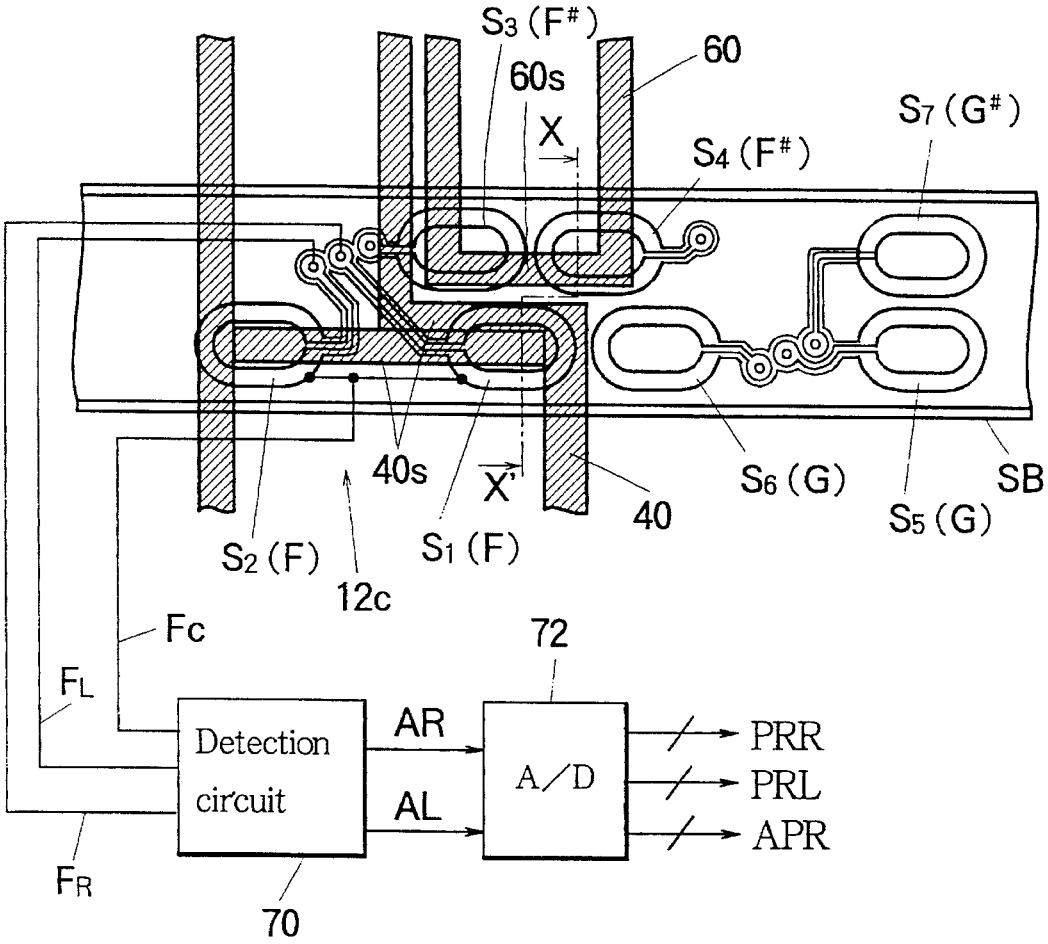
FIG. 5 is a top plan view of the pressure sensor shown in FIG. 4.

FIGS. 4 and 5 show a structural example of the pressure sensor 12*c*. FIG. 4 is a sectional view of the pressure sensor 12*c* shown in FIG. 5, taken along X–X' line. In this example, the pressure sensors are placed on a sensor substrate SB relative to the keys corresponding to notes F, F♯ and G, G♯, etc. Each of the pressure sensors is constituted to include two analog switches, respectively. In other words, as shown in FIG. 5, one pressure sensor 12*c* corresponding to the note F has a pair of analog switches S1 and S2, and the other pressure sensor corresponding to the note F♯ has a pair of analog switches S3 and S4. Also, the pressure sensor corresponding to the note G has analog switches S5 and S6 and the pressure sensor corresponding to the note G♯ has analog switches S7 and S8 (not shown).

The pressure sensor 12*c* corresponding to the natural key 40 and the pressure sensor corresponding to the chromatic key 60 adjacent to the above natural key, as shown in FIG. 5, are placed on the sensor substrate SB in opposed relation to the pressing portion 40*s* of the natural key 40 and the pressing portion 60*s* of the chromatic key 60, respectively. These analog switches are all composed of pressure-sensitive sensors formed by a pressure-sensitive film, a resistance value of which decreases in propotion to the aftertouch pressure applied from the pressing portion 40*s* of the natural key or the pressing portion 60*s* of the chromatic key. Each of the switches is constructed such that a lower resistance member CN1 and an upper conductive contact member CN2 both formed of pressure-sensitive ink are placed oppositely to each other through a spacer S, as shown in FIG. 4. Hereinbelow, both of CN1 and CN2 will be called simply as contact members. Then, a felt layer FE is provided over a rubber layer GM on the upside of switches S1, S4 so that the pushing pressure is imposed from the pressing portion 40*s* or 60*s* on each switch, e.g., S1, through a thick portion Tg of the rubber layer GM and the felt layer FE.

Each of the lower contact members of the pair of switches S1 and S2 is connected to a common input terminal FC of a detection circuit 70. The upper contact members of the switchs S1 and S2 are respectively connected to a right input terminal $F_R$ and a left input terminal $F_L$ of the detection circuit 70. The detection circuit 70 senses an analog right pressure signal AR and left pressure signal AL, respectively, outputted from the pair of switches S1 and S2 constituting the pressure sensor 12*c*.

To give an example, when the pressing portion 40*s* presses the switches S1 and S2 of the pressure sensor 12*c* after the depression of the corresponding natural key 40, the amplitude value of the pressure signal is increased in each switch in accordance with an increase in contact area of the contact member. Also, if the natural key 40 is torsionally swung right and left during the depression of the key 40 with a finger, the amplitude values of the pressure signals AR and AL sensed from the switches S1 and S2 can be differed since the right and left pushing pressures are different in the swinging state. As a result, a touch vibrato control etc. can be performed as will be described below. On the other hand, when releasing the natural key 40, the contact area of the contact member is reduced at each switch to reduce the amplitude value of the pressure signal.

The pressure signals AR and AL from the detection circuit 70 are then supplied to an analog/digital (A/D) conversion circuit 72 to be converted into corresponding digital pressure data PRR and PRL, respectively. The A/D conversion circuit 72 avarages the values of the pressure data PRR and PRL and outputs a mean pressure data APR representing the calculated avarage value, in parallel to the pressure data PRR and PRL. The pressure data PRR and PRL are used for touch vibrato control and the mean pressure data APR is used for playing-style judgment. Alternatively, either of PRR and PRL may be used for determination of the playing-style instead of APR.

Figure 6:
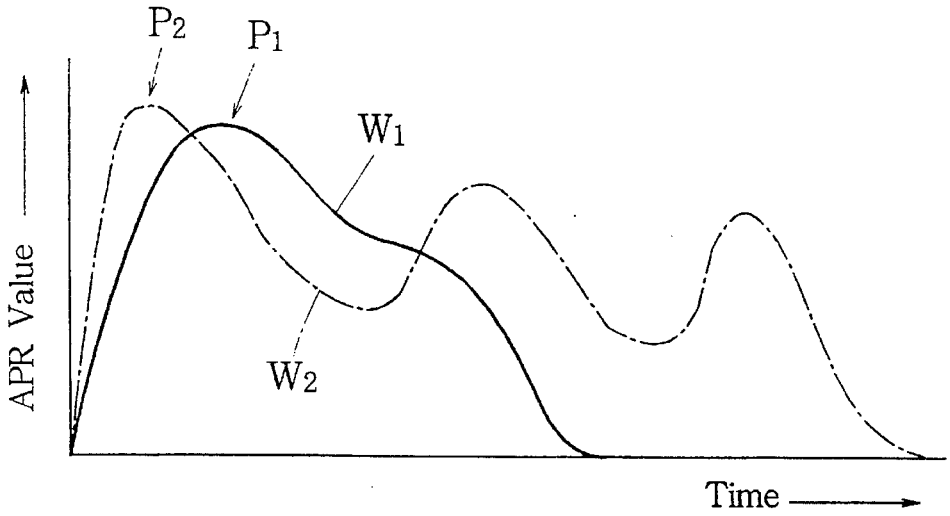
FIG. 6 is a graph illustrating a time-variation of pressure data values obtained from the pressure sensor.

FIG. 6 illustrates a time variation of the pressure data APR. A waveform W1 indicates a change of the APR value in case that the natural key 40 is instantly released after being pushed down. A waveform W2 indicates a change of the APR value in the case where the natural key 40 is released after repeating an aftertouch operation twice. The aftertouch operation is such that an applied force to the natural key 40 is slightly diminished in strength and then applied again, after depression of the natural key 40. Points P1 and P2 indicate first peaks of the applied force after the start of pushing down the natural key 40, respectively, on the waveforms W1 and W2. Regarding the pressure sensor corresponding to the chromatic key 60, the pressure data is detected in the same manner as described above with respect to the pressure sensor 12*c* corresponding to the natural key 40.

Figure 7:
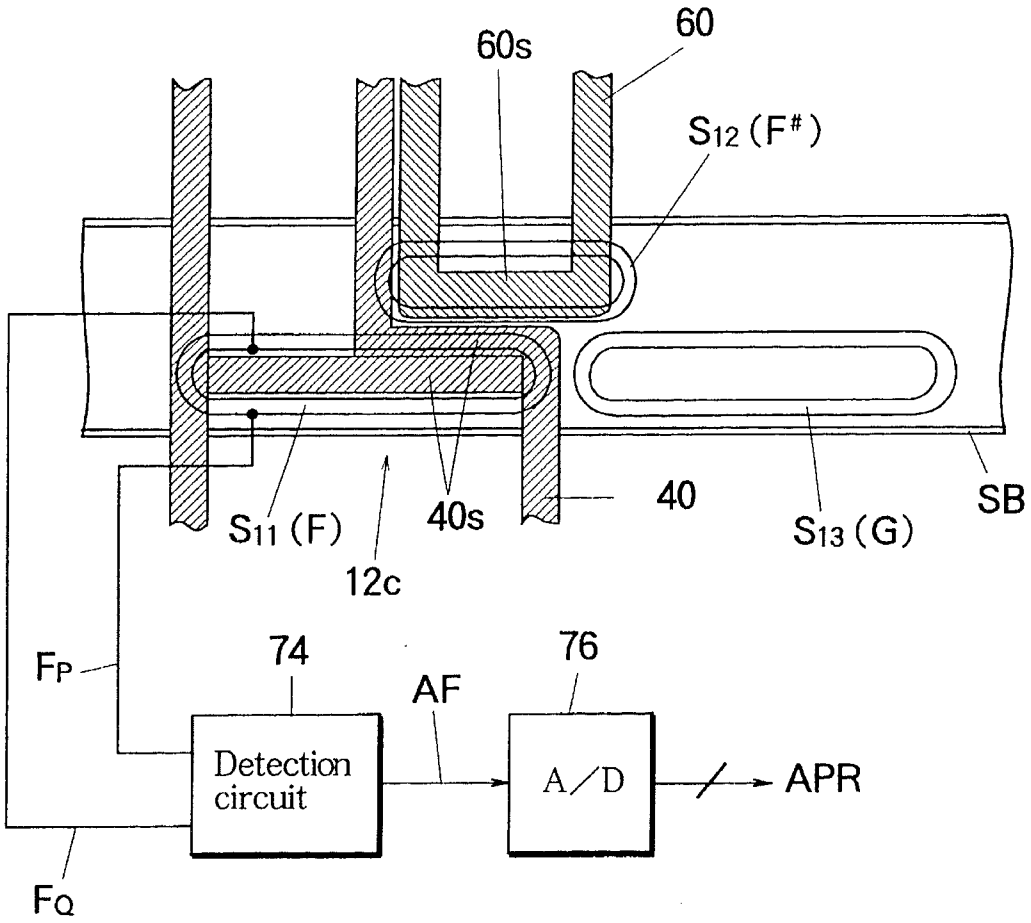
FIG. 7 is a top plan view showing another example of the pressure sensor.

FIG. 7 shows another example of the pressure sensor. In this example, a key corresponding to a note such as F, F♯ or G is provided with a pressure sensor one by one. Each pressure sensor, however, includes only one switch. That is, the pressure sensor 12*c* corresponding to the note F has a switch S11, the pressure sensor corresponding to the note F♯ has a switch S12 and the pressure sensor corresponding to the note G has a switch S13. In the pressure sensor 12*c*, a lower contact member of the switch S11 (corresponding to CN1 of FIG. 4) is connected to one input terminal FP of a detection circuit 74 and an upper contact member of the switch S11 (corresponding to CN2 of FIG. 4) is connected to another input terminal FQ of the detection circuit 74. The detection circuit 74 senses an analog pressure signal AF outputted from the switch S11 in the same manner as described above with respect to the detection circuit 70, and then supplies the signal AF to an A/D conversion circuit 76. As a result, a digital pressure data APR corresponding to the analog pressure signal AF can be obtained from the A/D conversion circuit 76. In the example of FIG. 7, each of the pressure sensors is constituted with one switch, so that the pressure data equivalent to the pressure data PRR and PRL cannot be obtained. On the other hand, the pressure data APR same as those of W1 and W2 of FIG. 6 can be obtained. Accordingly, it will be good to utilize the pressure sensor configration of FIG. 7 in case that the touch vibrato control etc. is not required.

Figure 8:
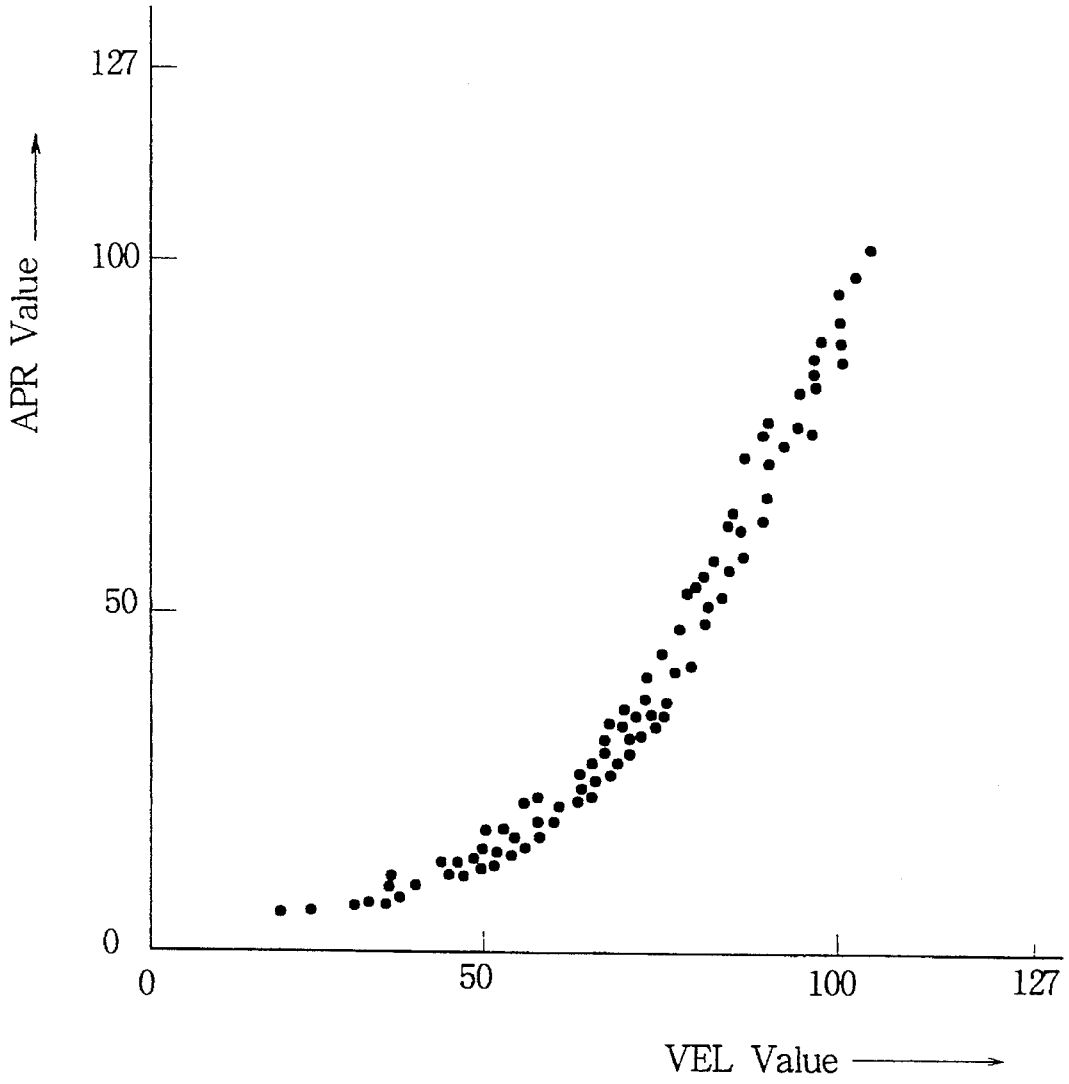
FIG. 8 is a graph illustrating a correlation between a speed data value and a pressure data value in the case where the pressure sensor is provided below a hammer of a key.

FIG. 8 shows a correlation between a speed data value and a pressure data value in case where the pressure sensor is provided below a hammer. In this case, a touch sensor 12*b* is provided below the hammer linked to a natural key corresponding to the note G in the keyboard unit of FIG. 2 so as to detect a speed data VEL representing the depression speed of the key corresponding to the note G by use of the touch sensor. On the other hand, the pressure sensor 12*c* is not provided below the natural key corresponding to the note G, but a sensor holding member 62 is provided below the hammer linked to the natural key corresponding to the note G so that a pressure sensor 12*c*' is installed on this holding member 62. Then, a pressure data APR representing a depression pressure of the hammer linked to the natural key corresponding to the note G is detected by the pressure sensor 12*c*'.

In FIG. 8, the horizontal axis shows values 0 to 127 of the speed data VEL, and the vertical axis shows values 0 to 127 of the pressure data APR. Each of black dots indicates a coordinate value of the speed data VEL and the pressure data APR, both obtained in one key depression operation. The value of the pressure data APR is selected corresponding to the first peak of the depression pressure after the start of touching the key as shown by P1 or P2 of FIG. 6, and the key depression operation is performed many times as shown by many black dots of FIG. 8. Then, a half of the key depression operations is performed by the standard playing-style with changes in strength of key depression, while the other half of the trials is performed by the push playing-style with changes in strength of key depression. From the results of the measurement shown in FIG. 8, however, it is difficult to distinguish the standard playing-style from the push playing-style.

Figure 9:
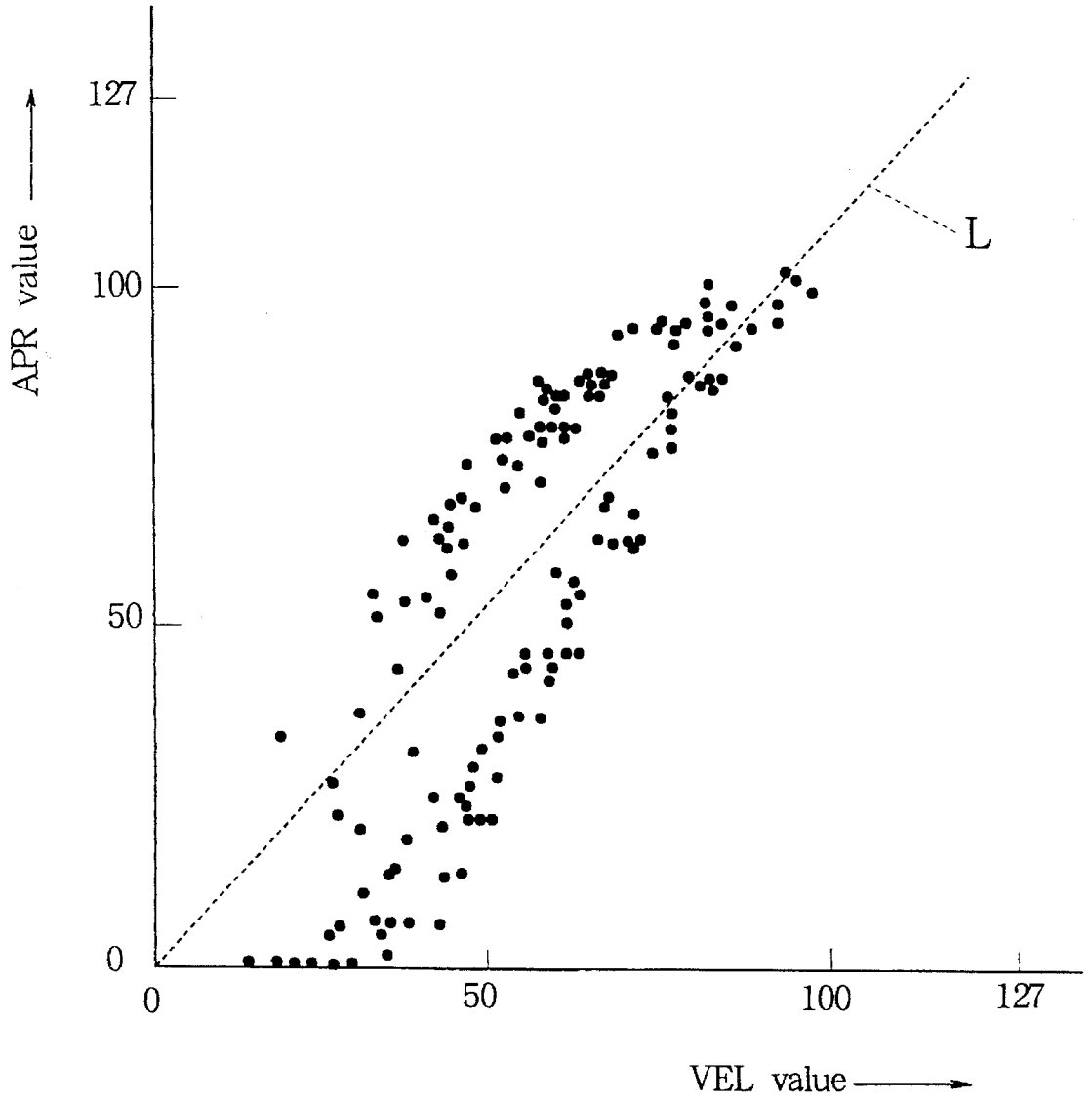
FIG. 9 is a graph illustrating a correlation between the speed data value and the pressure data value in the case where the pressure sensor is provided below a key.

FIG. 9 shows a correlation between a speed data value and a pressure data value in case that the pressure sensor is provided below a key. In this case, the pressure sensor 12*c* is provided below the key corresponding to the note G in the keyboard unit 12 of FIG. 2 instead of the pressure sensor 12*c*'. Then, the speed data VEL and the pressure data APR are measured in the same manner as described in conjunction with FIG. 8, and the results of the measurement are designated by the black dots. According to the results of the measurement shown in FIG. 9, measured values of the standard playing-style are distributed below a broken line L, while measured values of the push playing-style are distributed above the broken line L. Since the pressure sensor 12*c* is provided below the key, the delicate after pressure in the push playing-style becomes detectable effectively. In the embodiment of this invention, the playing-style is judged by utilizing the results of the measurement shown in FIG. 9 or the like.

Also, the playing-style can be judged by utilizing measures other than the results of the measurement of FIG. 9. In FIG. 9, the pressure data is obtained by use of the aftersensor which changes its resistance values according to the applied force. Then, the playing-style is judged based on the pressure data and the speed data outputted from a speed sensor. In addition, a shock absorbing material formed of elastic materials, such as the felt layer FE, urethane rubber or the like, is provided over the contact part of the pressure sensor 12*c*. That is, there exists a dynamic phenomenon accompanying a considerable displacement of the key rather than a static phenomenon of the pressure application. Accordingly, a proper shock absorbing material is provided so that the minute displacement is detected and the detected displacement is differentially processed twice (a second order differentiation), thereby detecting an acceleration. Then, by detecting the maximum change of the acceleration in the key depression direction, results of the measurement substantially same as that of the FIG. 9 embodiment can be obtained from the detected value of the acceleration at a peak point and from the above speed data VEL. This may be used for judgment of the playing-style. One of the methods for detecting the minute displacement accurately is disclosed in Japanese Patent Publication No. Hei 2-214897 which utilizes moire fringes.

Figure 10:
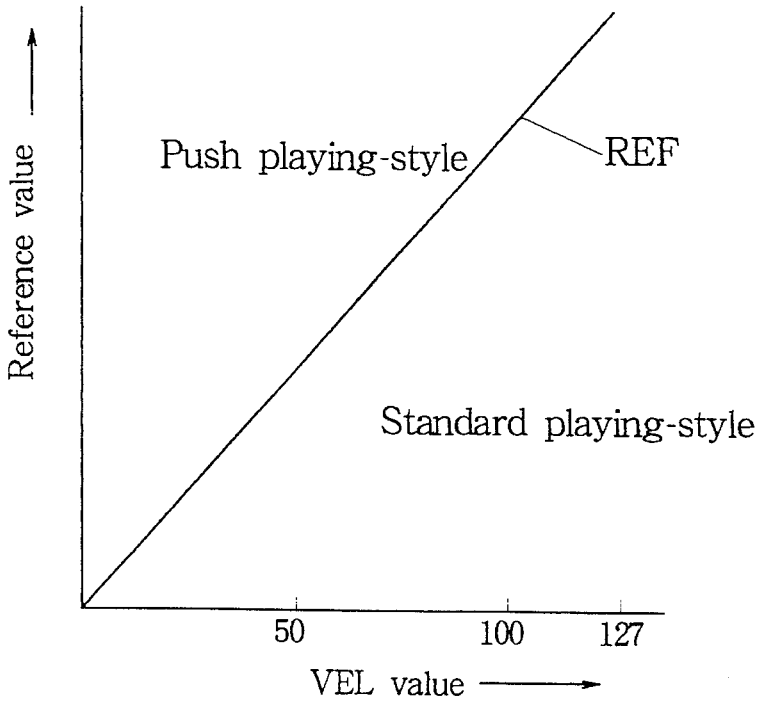
FIG. 10 is a graph showing contents of a reference table.

FIG. 10 shows a reference table memorized in the memory 16. In FIG. 10, the horizontal axis indicates a value of the speed data VEL and the vertical axis shows a reference value. The straight line REF is equivalent to the straight line L of FIG. 9 and represents a boundary between the standard playing-style and the push playing-style. The memory 16 memorizes the reference value corresponding to each VEL value of 0 to 127. Each reference value is used for the playing-style judgment. Namely, when the detected APR exceeds the REF, it is judged that the push playing-style is performed. On the other hand, in case of APR<REF, it is judged that the standard playing-style is performed.

Figure 11:
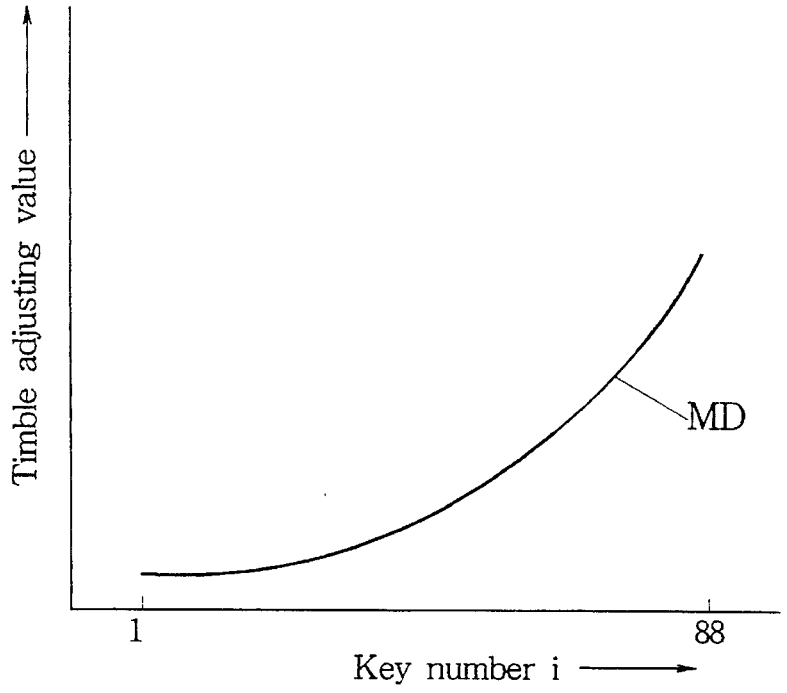
FIG. 11 is a graph showing contents of a tone adjustment table.

FIG. 11 shows a timbre adjustment table memorized in the memory 16 together as the reference table. In FIG. 11, the horizontal axis shows a key number i=1 to 88, and the vertical axis shows a timbre adjusting value. The curved line MD represents a state that the timbre adjusting value becomes larger as the pitch is higher. The memory 16 memorizes a timbre adjusting value corresponding to each key number along the curved line MD. Each timbre adjusting value is used for adjusting a tone control data (filter cut-off frequency data) at each pitch (key number).

Figure 12:
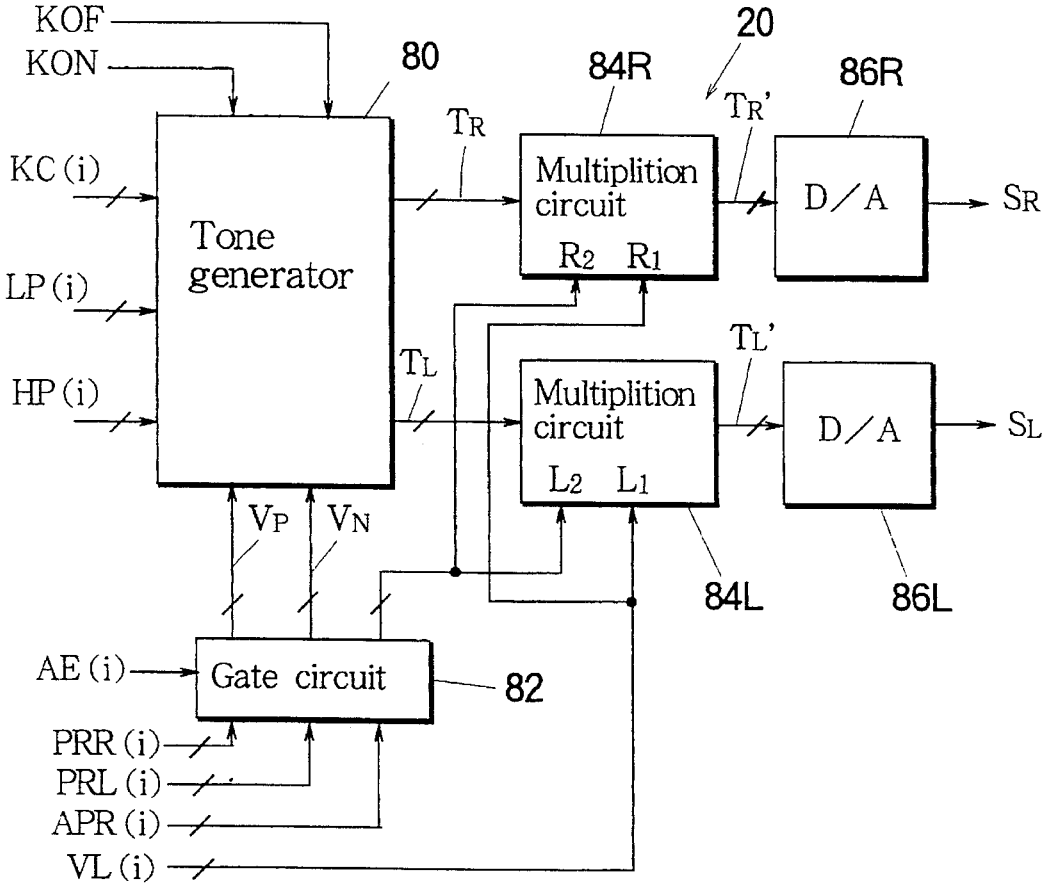
FIG. 12 is a block diagram showing a musical-tone signal generation circuit.

FIG. 12 shows a structural example of the musical-tone generation circuit 20. In FIG. 12, signal lines to which slant lines are appended are multi-bit lines for transferring a plurality of bits. A tone generator 80 generates a right channel musical-tone signal $T_R$ and a left channel musical-tone signal $T_L$ based on key code data KC(i) representing depressed keys and key-on signals KON. Here, pitches (frequencies) of the musical-tone signals are controlled in accordance with vibrato control inputs $V_N$ and $V_P$ at each channel. The musical-tone signals $T_R$ and $T_L$ both have the pitches corresponding to the pushed keys. The signals $T_R$ and $T_L$ are then controlled both to slightly reduce their own pitches according to the vibrato control input $V_N$ and to slightly increase the pitches according to the vibrato control input $V_P$.

When a gate circuit 82 is made open in response to a gate control signal AE(i)=1, pressure data PRR(i) and PRL(i) according to the pushing pressure of the key are transmitted respectively to be used as the vibrato control inputs $V_P$ and $V_N$. The pressure data PRR(i) and PRL(i) are equivalent to the pressure data PRR and PRL described in FIG. 5 and correspond to the right and left side pushing pressures of the same pushed key, respectively. Accordingly, if the pushing pressure at the right side of the key increases, the pitches of the musical-tone signals $T_R$ and $T_L$ will rise. On the other hand, if the pushing pressure at the left side of the same key increases, the pitches of the musical-tone signals $T_R$ and $T_L$ will lower. Thus, the touch vibrato effect can be obtained.

Figure 13:
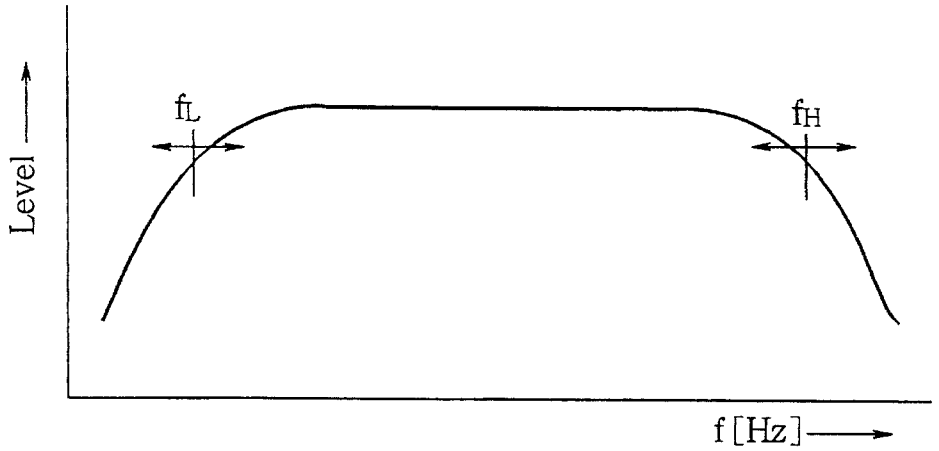
FIG. 13 is a graph of frequency characteristics illustrating a filter control operation.

The tone generator 80 is provided with a low pass filter LPF and a high pass filter HPF respectively at each channel. These filter LPF and HPF control their own cut-off frequencies according to the cut-off frequency control data LP(i) and HP(i). In other words, as shown in FIG. 13, a high cut-off frequency $f_H$ of the filter LPF is controlled high or low depending upon the cut-off frequency control data LP(i) as shown by arrows. On the other hand, a low cut-off frequency $f_L$ of the filter HPF is controlled high or low depending upon the cut-off frequency control data HP(i) as shown by arrows as well. As a result, the musical-tone signals $T_R$ and $T_L$ are outputted while their timbres are controlled.

The cut-off frequency controll data LP(i) and HP(i) are defined differently in each playing-style. For example, in case of the standard playing-style, the values of the data LP(i) and HP(i) are respectively obtained from the following equations (1) and (2).

$$LP(i)=MD(i)\cdot Cf_H \tag{1}$$

$$HP(i)=MD(i)\cdot Cf_L \tag{2}$$

In the above equations, MD(i) is a timbre adjusting value which corresponds to a key number i of a pushed key and which is read out from the timbre adjustment table of FIG. 11. $Cf_H$ is a value of control data for specifying the cut-off frequency $f_H$ of the low pass filter LPF, and $Cf_L$ is a value of control data for specifying the cut-off frequency $f_L$ of the high pass filter HPF.

On the other hand, in case of the push playing-style, the values of the data LP(i) and HP(i) are respectively obtained from the following equations (3) and (4).

$$LP(i)=MD(i)\left\{ Cf_H-\left(f_1-\frac{k_1}{VEL(i)}\right)\right\} \tag{3}$$

$$HP(i)=MD(i)\left\{ Cf_L-\left(f_2-\frac{k_2}{VEL(i)}\right)\right\} \tag{4}$$

In the above equations, MD(i), $Cf_H$ and $Cf_L$ are the same as those contained in the equations (1) and (2), and $f_1$, $f_2$, $k_1$ and $k_2$ are predetermined constants.

Multiplication circuits 84R and 84L receive the musical-tone signals $T_R$ and $T_L$, respectively. The multiplication circuit 84R multiplies the musical-tone signal $T_R$ by control data R1 or R2. The multiplication circuit 84L multiplies the musical-tone signal $T_L$ by control data L1 or L2. For the level control data R1 and L1, a speed data VL(i) representing the depression speed of a key is supplied. Also, for the level control data R2 and L2, a pressure data APR(i) according to the depression pressure of the key is supplied at the time when the gate circuit 82 is opened in response to the gate control signal AE(i)=1. The pressure data APR(i) is equivalent to the pressure data APR described in FIGS. 5 and 7.

The musical-tone signals $T_R$ and $T_L$ are multiplied by the speed data VL(i) so that the tone volume control according to the depression speed of the key can be carried out. Also, the musical-tone signals $T_R$ and $T_L$ are multiplied by the pressure data APR(i), thereby carrying out the tone volume control according to the depression pressure of the key.

The speed data VL(i) is defined to be different in playing-style. In other words, in case of the standard playing-style, the value of the data VL(i) uses the speed data VEL(i) detected from the touch sensor. In case of the push playing-style, the value of the data VL(i), for example, is obtained from the following equation (5). Namely, the tone level is raised in the lower range of VEL as compared to the standard playing-style.

$$VL(i)=VEL(i)+27-0.124VEL(i) \tag{5}$$

The musical-tone signals $T'_R$ and $T'_L$ outputted from the multiplication circuits 84R and 84L are supplied to digital/analog (D/A) conversion circuits 86R and 86L to be converted into corresponding analog musical-tone signals $S_R$ and $S_L$, respectively. On the contrary, when the key code data KC(i) and a key-off signal KOF both corresponding to a released key are supplied to the tone generator unit 80, the musical-tone signal corresponding to the key code data KC(i) starts damping. In addition, though not shown in FIG. 12, the musical-tone generation circuit 20 is provided with registers for setting of supplied signals or data.

Figure 14:
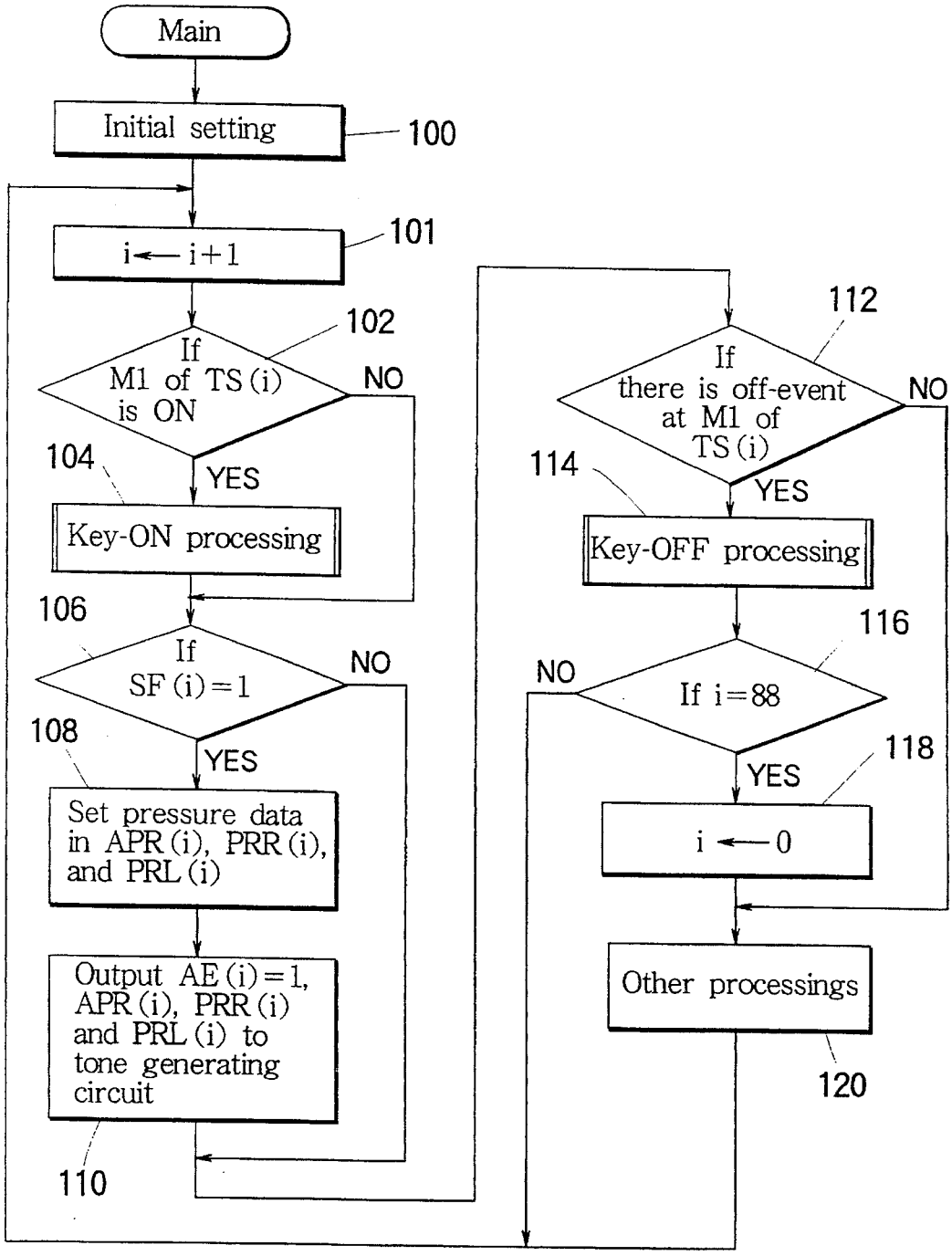
FIG. 14 is a flow chart showing a main routine.
Figure 15:
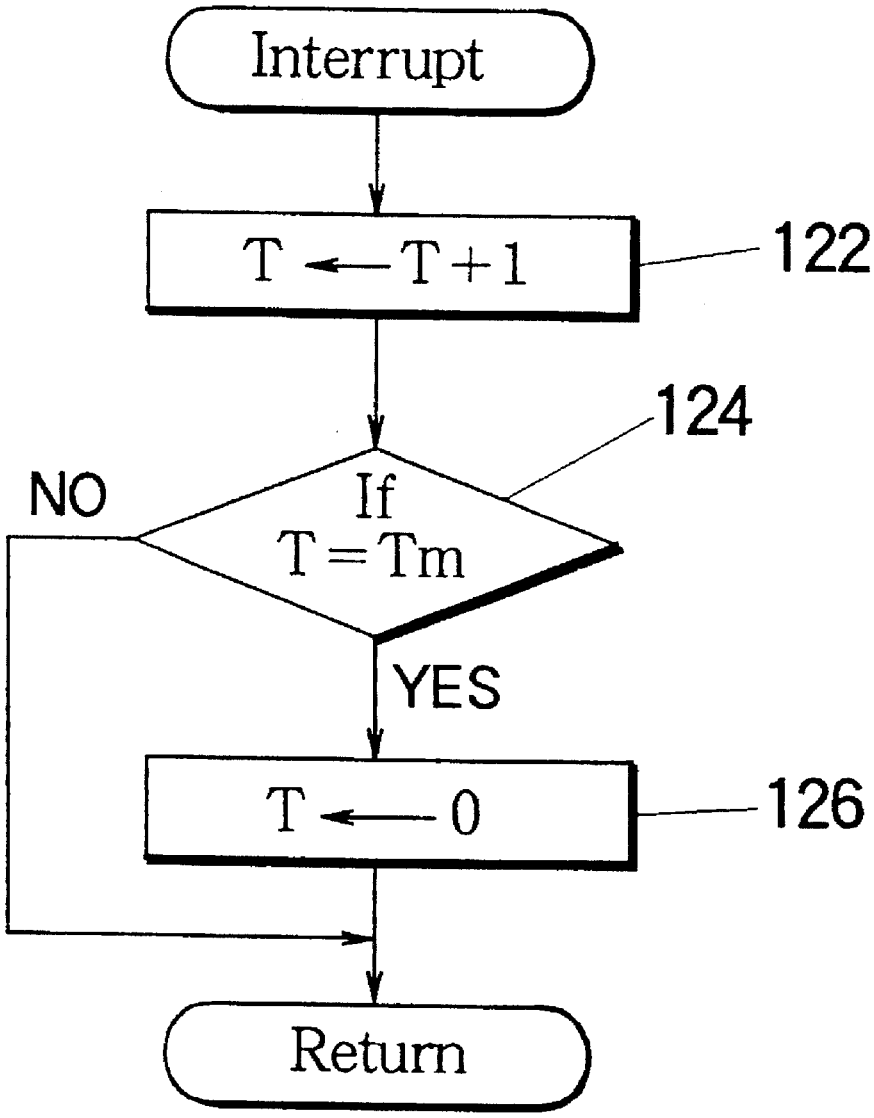
FIG. 15 is a flow chart showing an interruption routine.

FIG. 14 shows processings in a main routine. This routine starts from a switch-on of the power source. At first, a initial setting process is performed in step 100. For example, a register T for time measurement, a key-number register i and a sound generation flag SF(i) etc. are set to "0". Then, the value i is incremented by one in step 101. In other words, a change of state in the lowest key switch of i=1, out of 88 keys, is watched in steps 102 through 114 and various kinds of processing are repeated for each key.

Regarding a given i, the description will be now proceeded from step 102. In step 102, a switch M1 of a touch sensor TS(i) corresponding to a key of number i on the keyboard 12A is watched to judge as to whether "there is an on-event (key-on event)" and "the contact is continuously set on (the switch M1 being in the on-state)". If the resulting judgment is positive (Y), the processing proceeds to step 104 to perform a subroutine for a key-on processing as discussed later with reference to FIGS. 16 and 17.

If the resulting judgment is negative (N) or the processing of step 104 is ended, the routine goes to step 106 to judge whether the sound generation flag SF(i) is "1". If it is positive (Y), i.e., if the flag SF(i) is "1", it indicates that the musical-tone signal corresponding to the key-on event is in the state of sound generation and the procedure advances to step 108.

In step 108, pressure data APR(i), PRR(i) and PRL(i) detected from a pressure sensor under the key-on event are set, respectively, in registers APR(i), PRR(i) and PRL(i). Then, the routine goes to step 110 to output the pressure data of the registers APR(i), PRR(i) and PRL(i) together with the gate control signal AE(i) to the musical-tone generation circuit 20. In the circuit 20, the supplied data APR(i), PRR(i), PRL(i) and the signal AE(i) are set respectively in corresponding registers.

When the resulting judgment of step 106 is negative (N) or the processing of step 110 is ended, the routine goes to step 112 and judges whether there is an off-event (key-off event) at the switch M1 of the touch sensor TS(i) corresponding to the key held in the key-on event. As an aside, the judgment as to whether or not there is the key-off event may be performed by investigating whether there is the off-event at a switch M2 of the touch sensor. If the resulting judgment of step 112 is positive (Y), the routine goes to step 114 to perform a subroutine for a key-off processing as discussed later. On the contrary, if the resulting judgment of step 112 is negative (N), the routine goes to step 120.

After the processing of step 114 is finished, the routine moves to step 116 to judge whether the key currently in process is the highest key of i=88. If the resulting judgment is negative (N), the routine returns to step 101. Here, when steps 101 to 114 are repeated for each key (88 times), the resulting judgment of step 116 becomes positive (Y). After that, "i" is reset to "0" in step 118 and the procedure moves to next step 120. In step 120, other processings (e.g., timbre selection processing) are performed. After the processings of step 120 are finished, the procedure then returns to step 101 to repeat the above processings as well. According to the main routine of FIG. 14, when the flag SF(i) is set to "1", the pressure data APR(i), PRR(i), PRL(i) and the signal AE(i)=1 are outputted to the circuit 20 as passing the step 110, so that the sound volume control and vibrato control can be performed based on the key depression operation.

FIG. 15 shows an interrupt routine. This routine starts as an interrupt signal is generated from the timer 26 of FIG. 1. At first, the value of the register T for time measurement is incremented by one in step 122. Then, the procedure goes to step 124 to judge whether the value of the register T is equal to a predetermined maximum value Tm. if the resulting judgment is positive (Y), the routine goes to step 126 to clear the register T to "0". On the other hand, if the judgement is negative (N) or the processing of step 126 is finished, this routine returns to the main routine of FIG. 14. According to the interrupt routine of FIG. 15, the register T takes a value up to (Tm−1) from "0", and then is made clear to "0" after the value reaches Tm. Such an time-measuring operation is repeated. In other words, the register T designates a time value by counting the interrupt signal TI.

Figure 16:
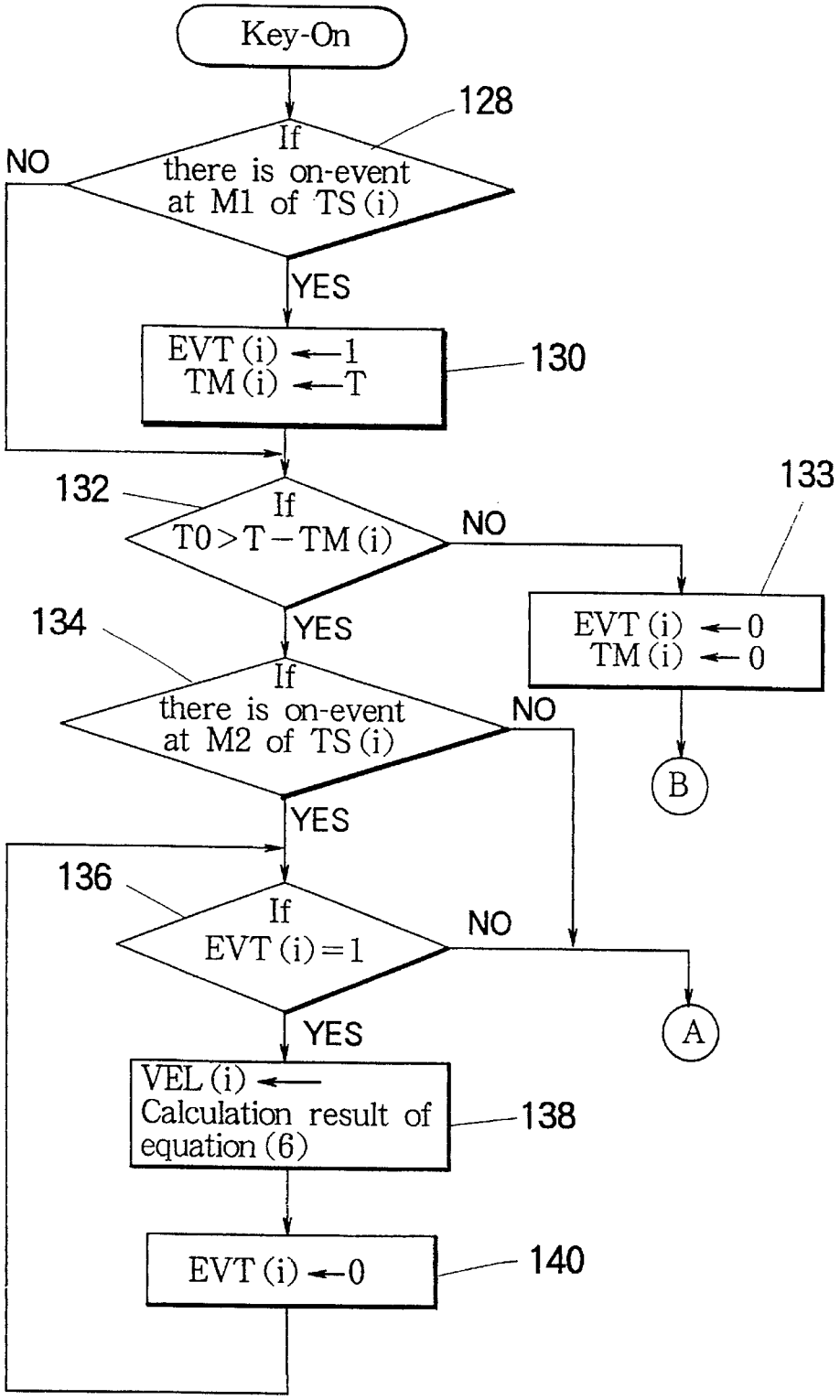
FIG. 16 is a flow chart showing a part of a subroutine for key-on processing.
Figure 17:
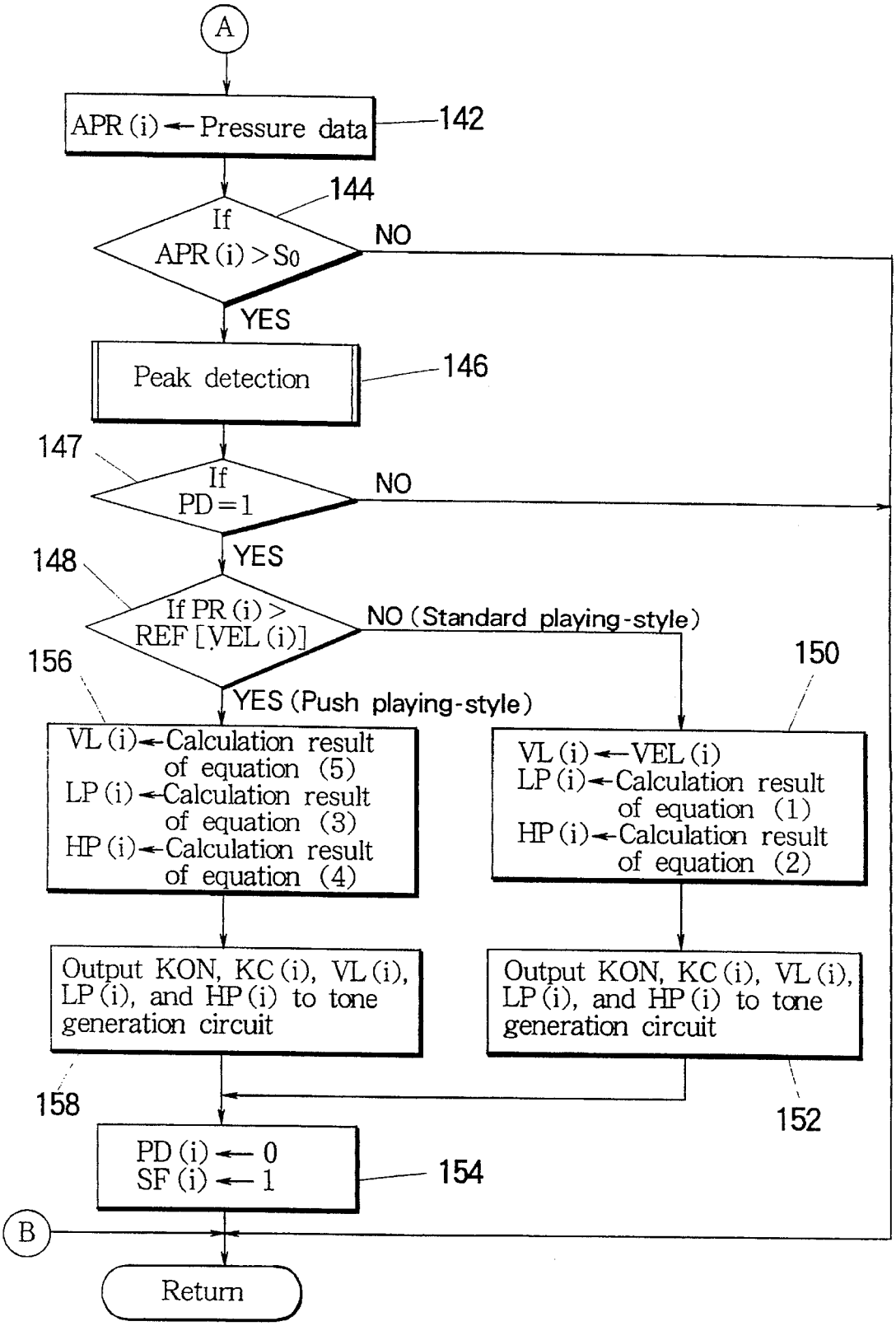
FIG. 17 is a flow chart showing another part of the subroutine for the key-on processing.

FIGS. 16 and 17 show a subroutine for the key-on processing. In step 102 of FIG. 14, when the switch M1 of FIG. 3 is turned on, the procedure enters the subroutine for the key-on processing. Then, in step 128, the judgment is made as to whether or not there is the on-event at the switch M1 of the touch sensor TS(i). If the resulting judgment is positive (Y), the routine goes to step 130 to set "1" into an event flag EVT(i), and to set the value of the register T in a time register TM(i). On the contrary, if the resulting judgment is negative (N), the routine goes to step 132 without doing anything.

In step 132, the judgment is made as to whether a subtracted value between the register TM(i) and the register T (i.e., an elasped time at the switch M1 of the TS(i) since its on-event occurrence) is smaller than a predetermined value T0. The value T0 is determined in advance in consideration of a time generally required for a next on-event occurrence of the switch M2 after the on-event occurrence of switch M1. The first time when the routine comes to step 132 after step 130, the resulting judgment of step 132 becomes positive (Y) and the procedure goes to step 134.

In step 134, the judgment is made as to whether there is on-event at the switch M2 of the sensor TS(i). The first time the routine cames to step 134 after step 130, the resulting judgment of step 134 becomes negative (N) and the procedure goes to step 142 of FIG. 17. Then, the processings in and after step 142 are performed and repeated to return again to this rutine. After a while, when the on-event occurs at the switch M2, the resulting judgment becomes positive (Y) and the procedure goes to step 136.

On the other hand, if the resulting judgment of step 132 is negative (N) after the perdetermined elasped time, it indicates that there is no on-event at the switch M2 of the sensor TS(i) within the predetermined time T0, so that the registers EVT(i) and TM(i) are both set to "0", and then the procedure returns to the main routine of FIG. 14.

In step 136, the judgment is made as to whether the flag EVT(i) is set to "1". The first time the routine cames to step 136 after step 134, the resulting judgment of step 136 becomes positive (Y) and the procedure goes to step 138. In step 138, the speed data VEL(i) is calculated by the following equation (6), and is set in a register VEL(i).

$$VEL(i) = \frac{1}{T - TM(i)} \tag{6}$$

where, T and TM(i) express the values of the registers T and TM(i), respectively. The value of the speed data VEL(i) is the reciprocal of the clasped time or interval time until the on-event occurs at the switch M2 of the sensor TS(i) after the on-event occurrence of the switch M1 of the sensor TS(i). After step 138, the flag EVT(i) is set to "0" in step 140. Then, the procedure returns to step 136 to judge whether the EVT(i) is "1". While the above judgment becomes negative (N), the procedure goes to step 142 of FIG. 17.

In step 142 of FIG. 17, the pressure data APR(i) detected from the pressure sensor is set in the register APR(i). Then, the procedure advances to step 144, where the judgement is made as to whether the pressure data value set in the register APR(i) is greater than a predetermined value S0. The value S0 is set slightly greater than 0. When the routine initially advances to step 144 via step 142, the resulting judgment of step 144 generally becomes negative (N). In other words, even if the key is pushed down, the pressure sensor 12*c* is not yet pressed by the pressing portion 40*s* or 60*s*. Therefore, the resulting judgment of step 144 becomes negative (N) and the procedure returns to the routine of FIG. 14.

When the pressure seonsor 12*c* is pressed by the pressing portions 40*s* or 60*s*, the resulting judgment of step 144 becomes positive (Y) and the procedure goes to step 146. In step 146, a subroutine for peak detection is performed as discussed later in FIG. 18. Then, the routine goes to step to judge whether the value of a peak detection flag PD is "1" (whether the peak detection is finished). If the resulting judgment is negative (N), the processing returns to the main routine of FIG. 14. On the other hand, if the judgement is positive (Y), the procedure goes to step 148.

In step 148, the playing-style judgment is performed. In other words, a reference value REF [VEL(i)] corresponding to the speed data VEL(i) is read from the reference table of FIG. 10 to judge whether the value of a register PR(i) is greater than the above reference value. The register PR(i) is set with a pressure data corresponding to the first peak of the depression force after the start of touching the key (e.g., P1 of FIG. 6). This is set by the processing in step 146.

If the resulting judgment of step 148 is negative (N), it indicates that the standard playing-style is conducted in the depression of the corresponding key, and then the procedure goes to step 150. In step 150, the speed data of the register VEL(i) is set in a register VL(i), the result of the calculation by the equation (1) is set in a register LP(i), and the result of the calculation by the equation (2) is set in a register HP(i). In step 152, the key-on signal KON, the key code data KC(i) representing the key on the key-on event, the speed data VL(i) set in the register VL(i) and the cut-off frequency control data HP(i) set in the register HP(i) are outputted to the musical-tone generation circuit 20. These signals and data are set in corresponding registers inside the circuit 20. Then, the musical-tone signals $S_R$ and $S_L$ that have a pitch corresponding to the key of the key-on event are generated from the circuit 20 with a sound volume level corresponding to the data VL(i) and timbre characteristics corresponding to the data LP(i) and HP(i). After step 152, the procedure goes to step 154 to set "0" into the peak detection flag PD and to set "1" into the sound generation flag SF(i). Then, the routine returns to the main routine of FIG. 14. In the main routine of FIG. 14, the touch vibrato control and the volume level control can be performed, by the processings in steps 106 to 110, with respect to the musical-tone signals being currently generated.

On the other hand, if the resulting judgment of step 148 is positive (Y), it indicates that the push playing-style is adopted for the depression of the corresponding key, and then the procedure goes to step 156. In step 156, the result of the calculation by the equation (5) is set in the register VL(i), the result of the calculation by the equation (3) is set in the register LP(i), and the result of the calculation by the equation (4) is set in the register HP(i). Then, the routine goes to step 158. In step 158, the key-on signal KON, the key code data KC(i) representing the key of the key-on event, the speed data VL(i) set in the register VL(i) and the cut-off frequency control data LP(i) set in the register HP(i) are all outputted to the musical-tone generation circuit 20. These signals and data, are set in corresponding registers inside the circuit 20. Then, the musical-tone signals $S_R$ and $S_L$ that have a pitch corresponding to the key of the key-on event are generated from the circuit 20, with a sound volume level corresponding to the data VL(i) and with timbre characteristics corresponding to the data LP(i) and HP(i). After step 158, the flag PD is set to "0" and the flag SF is set to "1" in step 154, and the procedure returns to the main routine of FIG. 14. In this case, the main routine of FIG. 14 can perform the touch vibrato control and the volume level control with respect to the musical-tone signals being currently generated.

Figure 18:
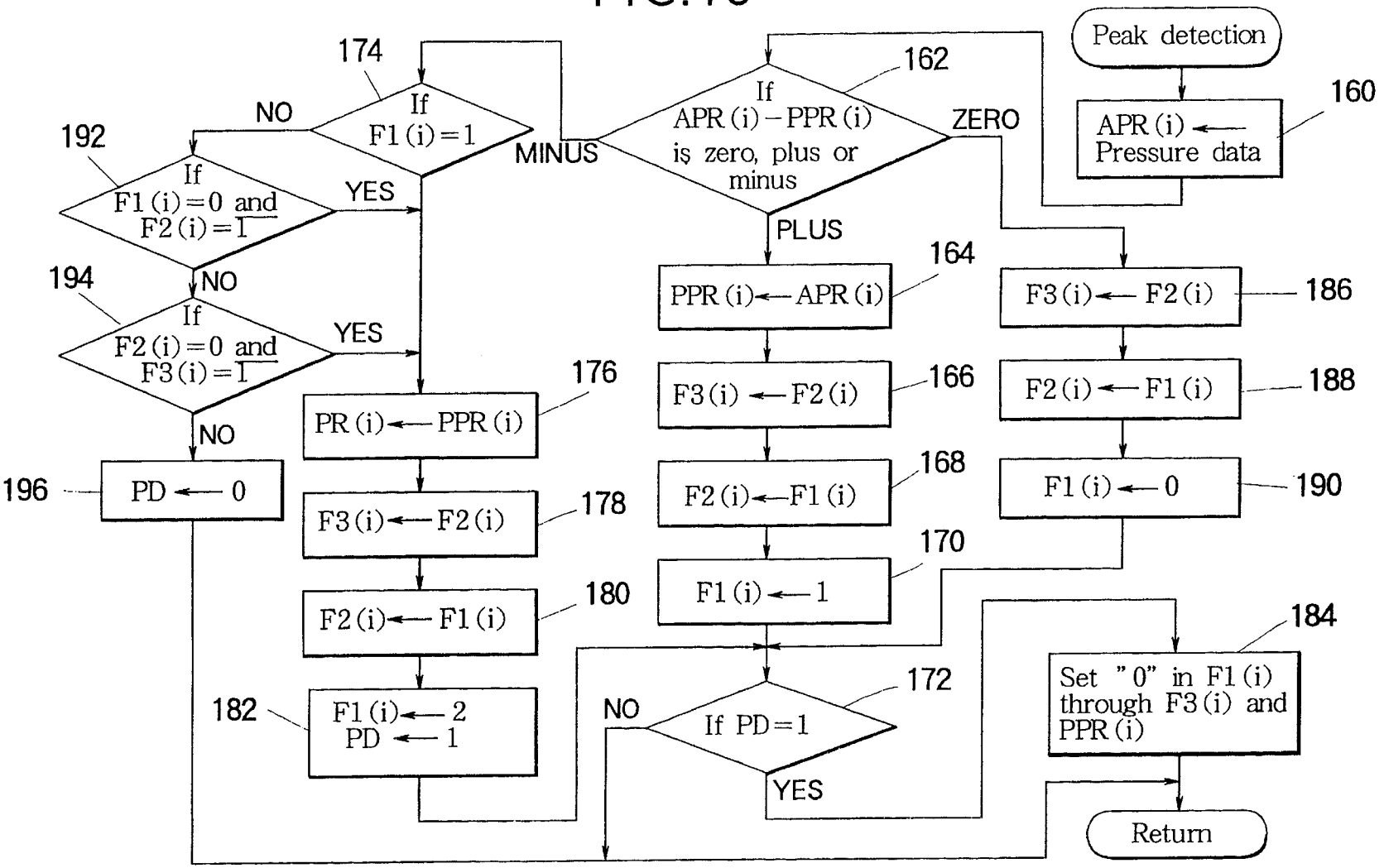
FIG. 18 is a flow chart showing a subroutine for peak detection.

FIG. 18 shows a subroutine for the peak detection. In step 160, the pressure data APR(i) detected in step 144 is first set in the register APR(i). Then, the procedure goes to step 162 to judge whether a subtracted value between the register PPR(i) and the register APR(i) is zero, plus or minus. The register PPR(i) is provided for setting the previous value instead of the present value of the register APR(i) and the initial value thereof is set to "0". The first time the routine cames to step 162 after step 144, the resulting judgment of step 162 becomes "plus" and the procedure moves to step 164.

In step 164, the pressure data of the register APR(i) is set in the register PPR(i). Then, the value of a register F2(i) is set in a register F3(i) in step 166, the value of a register F1(i) is set in the register F2(i) in step 168, and the register F1(i) is set to "1"(increase mode), respectively.

Figure 19A:
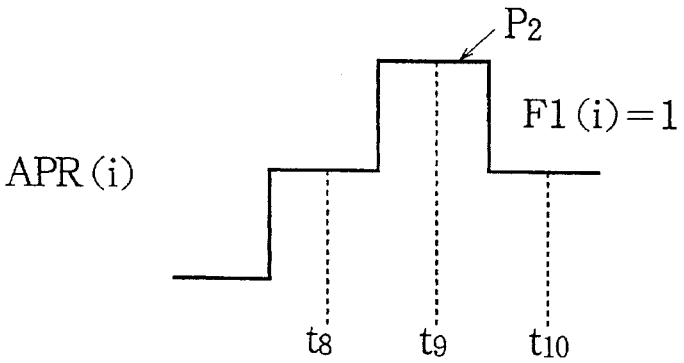
FIGS. 19A and 19B are timing charts illustrating the peak detection operation.

Next, in step 172, the judgment is made as to whether the peak detection flag PD is "1". The flag PD is set to "0" as the initial value, so that the resulting judgment of step 172 first becomes negative (N), thereby returning to the routine of FIG. 17 to finish the processings in and after step 147. When the procedure returns to step 160 again for the peak detection processing, the processings after step 160 are repeated in the same manner as those described above. To give an example, when the value of the register APR(i) increases toward the peak P2, as shown by the waveform W2 of FIG. 6, if the procedure passes through steps 166 to 170 three times or more, the values set in the registers F1(i) to F3(i) all becomes "1". As shown in FIG. 19A, a value preceding to the peak P2 of the depression pressure is set into the register APR(i) at timing t8 by step 160, so that, when the procedure comes to step 162, the resulting judgment of step 162 becomes "plus" and the processings in steps 164 to 170 are performed. Then, at timing t9, the value corresponding to peak P2 of the depression pressure is set into the register APR(i) by step 160, so that, when the procedure comes to step 162, the resulting judgment of step 162 becomes "plus" and the processings in steps 164 to 170 are performed. At this time, the pressure data (data corresponding to the peak P2 of the depression pressure) of the register APR(i) is set in the register PPR(i) in step 164. Also, the register F1(i) is set to "1" in step 170.

After this, at timing t10, a next value succeeding to the peak P2 of the depression pressure is set into the register APR(i), so that, when the procedure comes to step 162, the resulting judgment of step 162 becomes "minus", and the routine branches to step 174. In step 174, the judgment is made as to whether the value of the register F1(i) is "1". Since the register F1(i) is set to "1" at timing t9 by step 170, the resulting judgment of step 174 becomes positive/Y), and the routine goes to step 176. In step 176, the pressure data of the register PPR(i) is set in the register PR(i). At this time, the pressure data set in the register PR(i) corresponds to the peak P2 of the depression pressure.

After step 176, the processings in steps 178 to 182 are performed. In other words, the value of the register F2(i) is set in the register F3(i) in step 178, the value of the register F1(i) is set in the register F2(i) in step 180, and the register F1(i) is set to "2"(decrease mode), respectively. Also, the flag PD is set to "1" in step 182.

After this, when the procedure comes to step 172, the resulting judgment becomes positive (Y) and the routine goes to step 184. In step 184, the registers F1(i)through F3(i) and PPR(i) are all set to "0" and the procedure returns to the routine of FIG. 17.

Figure 19B:
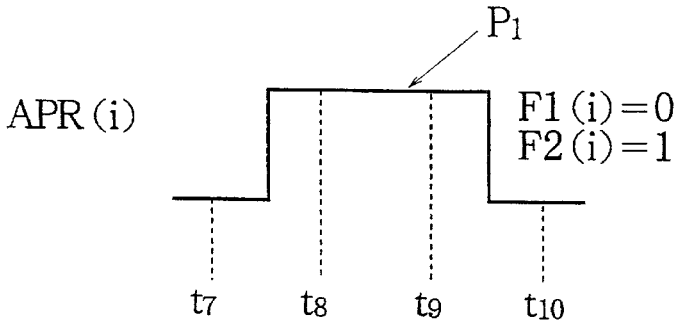

As another example, another peak detection operation will be described with respect to a flat shaped peak P1 of the depression pressure, as shown by the waveform W1 of FIG. 6. As shown in FIG. 19B, a value preceding to the peak P1 of the depression pressure is set into the register APR(i) at timing t7 by step 160, so that, when the procedure comes to step 162, the resulting judgment of step 162 becomes "plus" and the processings in steps 164 to 170 are performed. Then, at timing t8, the value corresponding to the peak P1 of the depression pressure is set into the register APR(i) by step 160, so that, when the procedure comes to step 162, the resulting judgment of step 162 becomes "plus" and the processings in steps 164 to 170 are performed. At this time, the pressure data (data corresponding to the peak P1 of the depression pressure) of the register APR(i) is set in the register PPR(i) in step 164. Also, the registers F3(i), F2(i) and F1(i) are all set to "1".

Next, at timing t9, the value also corresponding to peak P1 of the depression pressure is set into the register APR(i) by step 160, so that, when the procedure comes to step 162, the resulting judgment of step 162 becomes "0", and the processings in steps 186 to 190 are performed. In other words, the value of the register F2(i) is set in the register F3(i) in step 186, the value of the register F1(i) is set in the register F2(i) in step 188, and the register F1(i) is set to "0" (flat mode) in step 190. As a result, the values of the registers F3(i), F2(i) and F1(i) become "1", "1" and "0", respectively. After this, the procedure returns to the routine of FIG. 17 via step 172.

At timing t10, a value succeeding to the peak P1 of the depression pressure is set into the register APR(i), so that, when the procedure comes to step 162, the resulting judgment of step 162 becomes "minus", and the routine goes to step 192 via step 174. In step 192, the judgment is made as to whether the value of the register F1(i) is "0" and the value of the register F2(i) is "1". Since the registers F2(i) and F1(i) are set respectively to "1" and "0" at timing t9 by steps 188 and 190, the resulting judgment of step 192 becomes positive (Y) and the routine goes to step 176. Then, after the processings in steps 176 through 182, 172 and 184 are performed in the same manner as those described above, the procedure returns to the routine of FIG. 17.

To give a further example, in FIG. 19B, after the value corresponding to the peak P1 of the depression pressure continnes up to timing t10, if it is lowered at next timing t11 (not shown), the processings in steps 186 to 190 are performed once more, so that the registers F3(i), F2(i) and F1(i) are set, respectively, to "1", "0" and "0". After this, when the procedure comes to step 162 via step 160, the resulting judgment becomes "minus" and the procedure goes to step 194 via step 192. In step 194, the judgment is made as to whether the value of the register F2(i) is "0" and the value of the register F3(i) is "1". Since this result becomes positive (Y), the procedure goes to step 176 and then the processings after step 176 are performed in the same manner as those described above. If the results in steps 174, 192 and 194 are all negative (N), the flag PD is set to "0" in step 196 and the procedure returns to the routine of FIG. 17.

Figure 20:
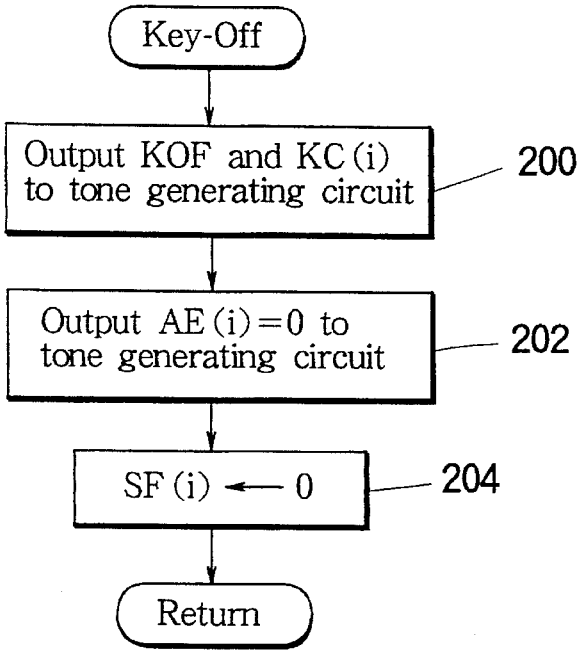
FIG. 20 is a flow chart showing a subroutine for key-off processing.
Figure 21:
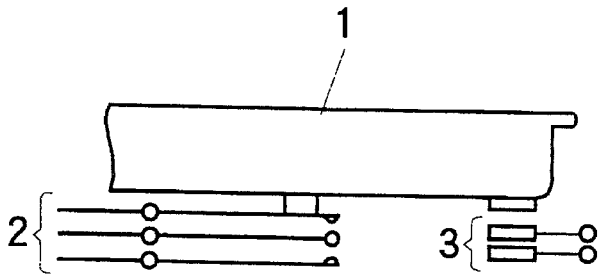
FIG.21 PRIOR ART
FIG. 21 is a side view showing a configuration of a touch sensor and a pressure sensor in a conventional keyboard.
Figure 22A:
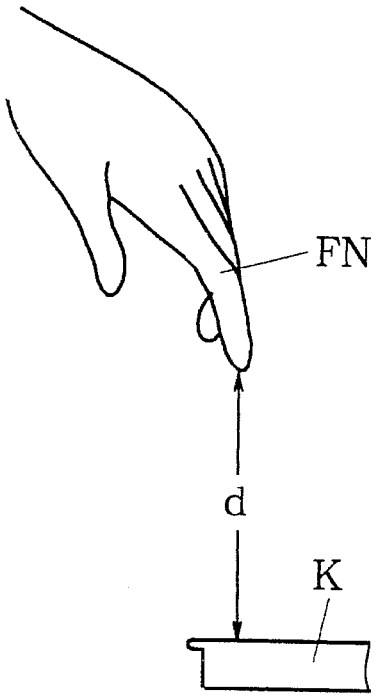
FIG.22A PRIOR ART
FIGS. 22A and 22B are side views illustrating different playing-styles.
Figure 22B:
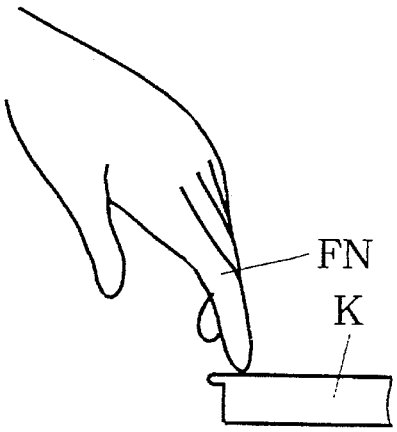
FIG.22B PRIOR ART

FIG. 20 shows a subroutine for the key-off processing. In step 200, a key-off signal KOF and the key code data KC(i) representing the key on the key-off event are outputted to the musical-tone generation circuit 20. As a result, the musical-tone signals $S_R$ and $S_L$ generated in step 104 of FIG. 14 start damping. Next, the routine goes to step 202 to output the gate control signal AE(i)=0 to the musical-tone signal generation circuit 20. Accordingly, the gate circuit 82 of FIG. 12 is held in the non-conductive state. Also, the sound generation flag SF(i) is set to "0" in step 204. After this, the procedure returns to the main routine of FIG. 14. In the main routine of FIG. 14, the judgment is made as to whether the key information being currently processed is the last key (the highest pitch key if processed from the lowest key), i.e., whether i=88. In case of an intermediate key, the resulting judgment becomes negative (N) and the procedure returns to step 101 to increment the value i by one. Then, the processings of next key information are performed from step 102. In case of the last key (i.e., i=88), the value i=0 is set in step 118, and the other processings are performed in step 120.

In the above embodiment, although the pressure sensor is used for the aftersensor, the present invention is not limited thereto. A displacement sensor may be used instead of the pressure sensor so that the playing-style judgment is performed based on an acceleration data obtained from the displacement sensor and the speed data during the key depression. Also, an impact sensor such as a piezo device may be used for the aftersensor.

As described above, according to the above embodiment, the aftersensor is provided for each key, so that a plurality of tone processings can be performed at the same time. Accordingly, the following effects can be obtained. For example, the push playing-style is performed by the left hand, while the standard playing-style is performed by the right hand (the reverse is also acceptable), thereby changing the timbre of the musical tones completely. Examples of the change are shown in the following table.

| Timbre of Left-Hand Part | Timbre of Right-Hand Part |
|---|---|
| Piano | Cembalo |
| Guitar | Piccolo or Flute |
| Organ | Violin or Viola |
| Continuous Type Tone (e.g., cello) | Attenuating Type Tone (recorder) |
| Organ | Chorus (Voices) |

As shown in the above table, in order to make it possible to differentiate timbres among various playing-styles completely, the apparatus is just operated to perform the timbre change processing in step 120. In other words, the timbre information supplied to the sound source unit of FIG. 12 is generally changed and controlled in step 120 according to the timbre switch on/off. At this time, a flag is set up after the playing-style judgment, the generated flag information as the playing-style detecting signal is used as timbre change information as well as the timbre switch on/off information to change and control the timbre information supplied to the sound source unit of FIG. 12. As a result, the timbre change processing can be attained easily by the above additional step.

The present invention is not limited to the above embodiments, but various modifications can be carried out. For example, the following variations can be achieved. In the above embodiment, although the musical-tone generation is started after the peak detection, it may be started before the peak detection after detecting the speed data VEL(i). In other words, after step 138 of FIG. 16, the speed data is set in the register VL(i) to be supplied to the musical-tone generation circuit 20 together with the key-on signal KON and the key code data KC(i), so that the generation of the musical-tone signal can start. In this case, outputs of the signal KON and the data KC are omitted in steps 152 and 158 of FIG. 17. Furthermore, although the control data are obtained from the corresponding calculations in steps 150 and 156 of FIG. 17, the results of the calculation can be memorized in the memory and used by reading out the same. Furthermore, the playing-style detection can be performed, instead of comparison with the reference value, by investigating whether the pair of the speed and pressure data belong to a predetermined range defined for each playing-style.

As discussed above, according to the present invention, the playing-styles of the key touch are detected so that the musical-tone control is performed according to the detercted playing-style, and this makes it possible to obtain an effect which enables to exhibit various expressions on performance in the electronic musical instruments, the performance being equivalent to or more than that in acoustic keyboard instruments such as a piano and the like.

What is claimed is:

1. A playing-style detecting appratus comprising:

a key operable to undergo a movement of depression;

first detection means for detecting a first output data corresponding to a depression speed of said key;

second detection means having an aftersensor provided under said key for detecting a second output data corresponding to an initial peak of a force applied to the key after a start of the depression of said key; and judgment means for determining a playing-style which is conducted in the depression of said key based on both of the first output data from said first detection means and the second output data from said second detection means, and for outputting playing-style information which represents the determined playing-style.

2. A playing-style detecting apparatus according to claim 1, wherein the judgment means comprises means for determining a standard playing-style when the first output data is relatively high and the second output data is relatively low, and for determining a push playing-style when the first output is relatively low and the second output data is relatively high.

3. A playing-style detecting apparatus according to claim 1, wherein the second detection means has an aftersensor positioned to come into direct contact with an actuating portion of the key when the same is depressed downward.

4. A playing-style detecting apparatus according to claim 3, wherein the aftersensor comprises an analog sensor formed of a pressure-sensitive film which has a variable electric resistance which decreases in proportion to the force applied the key.

5. A playing-style detecting apparatus according to claim 1, wherein the second detection means has an aftersensor positioned to come into indirect contact with an actuating portion of the key though a cushion layer when the key is depressed downward.

6. A playing-style detecting apparatus according to claim 5, wherein the cushion layer comprises a felt material.

7. A playing-style detecting apparatus according to claim 1, wherein the second detection means has a pair of left and right aftersensors disposed widthwise of one key for generating a corresponding pair of left and right pressure signals which represent leftside and rightside components of the force applied to the one key.

8. A playing-style detecting apparatus according to claim 7, wherein the second detection means includes means for detecting the second output data according to either of the left and right pressure signals.

9. A playing-style detecting apparatus according to claim 7, wherein the second detection means includes means for detecting the second output data according to an averaged value of the left and right pressure signals.

10. A playing-style detecting apparatus according to claim 1, wherein the first detection means comprises means for processing an output signal from the aftersensor to detect the first output data.

11. A playing-style detecting apparatus according to claim 1, wherein the second detection means comprises means for time-sequentially processing an output signal successively produced from the aftersensor so as to detect the initial peak of the force applied to the key.

12. An electronic musical instrument comprising:

a keyboard having a plurality of keys each being operable to undergo a movement of depression;

first detection means for detecting a first output data corresponding to a depression speed of each key on said keyboard;

second detection means having a plurality of aftersensors provided under the respective keys on said keyboard for detecting a second output data corresponding to an initial peak of a force applied to each key after a start of the depression of each key;

judgment means for determining a playing-style which is conducted in the depression of each key based on both of the first output data from said first detection means and the second output data from said second detection meters, and for outputting playing-style information that represents the determined playing-style;

musical-tone generation means for generating a musical-tone signal corresponding to each of the operated keys on said keyboard; and control means for controlling tone characteristics of the musical-tone signal generated by said musical-tone generation means in accordance with the playing-style information fed from said judgment means.

13. An electronic musical instrument according to claim 12, wherein the control means includes means for controlling a tone volume in the tone characteristics.

14. An electronic musical instrument according to claim 12, wherein the control means includes means for controlling a timbre in the tone characteristics.

15. An electronic musical instrument according to claim 12, wherein the judgment means comprises means for determining a standard playing-style when the first output data is relatively high and the second output data is relatively low, and for determining a push playing-style when the first output data is relatively low and the second output data is relatively high.

16. An electronic musical instrument according to claim 12, wherein the second detection mean has an aftersensor positioned to come into direct contact with an actuating portion of the key when the same is depressed downward.

17. An electronic musical instrument according to claim 16, wherein the aftersensor comprises an analog sensor formed of a pressure-sensitive film which has a variable electric resistance which decreases in proportion to the force applied the key.

18. An electronic musical instrument according to claim 12, wherein the second detection means has an aftersensor positioned to come into indirect contact with an actuating portion of the key through a cushion layer when the key is depressed downward.

19. An electronic musical instrument according to claim 18, wherein the cushion layer comprises a felt material.

20. An electronic musical instrument according to claim 12, wherein the second detraction means has a pair of left and right aftersensors disposed widthwise of one key for generating a corresponding pair of left and right pressure signals which represent leftside and rightside components of the force applied to the one key.

21. An electronic musical instrument according to claim 20, wherein the second detection means includes means for detecting the second output data according to either of the left and right pressure signals.

22. An electronic musical instrument according to claim 20, wherein the second detection means includes means for detecting the second output data according to an averaged value of the left and right pressure signals.

23. An electronic musical instrument according to claim 12, wherein the first detection means comprises means for processing an output signal from the aftersensor to detect the first output data.

24. An electronic musical instrument according to claim 12, wherein the second detection means comprises means for time-sequentially processing an output signal successively produced from the aftersensor so as to detect the initial peak of the force applied to the key.

25. An electronic musical instrument according to claim 15, wherein the control means includes means operative when the playing-style information indicates the push playing style for controlling the tone characteristics such that a tone volume of the musical-tone signal is raised as the depression speed of the key decreases as compared to the standard playing-style.

26. An electronic musical instrument according to claim 15, wherein the control means comprises means for changing a timbre kind in the tone characteristics of the musical-tone signal between the standard playing-style and the push playing-style.

* * * * *